US009151112B2

(12) United States Patent
Niemela

(10) Patent No.: US 9,151,112 B2
(45) Date of Patent: Oct. 6, 2015

(54) TREE CLIMBING SUPPORT

(71) Applicant: Cal G. Niemela, Chassell, MI (US)

(72) Inventor: Cal G. Niemela, Chassell, MI (US)

( * ) Notice: Subject to any disclaimer, the term of this patent is extended or adjusted under 35 U.S.C. 154(b) by 0 days.

(21) Appl. No.: 13/949,869

(22) Filed: Jul. 24, 2013

(65) Prior Publication Data

US 2014/0027204 A1 Jan. 30, 2014

Related U.S. Application Data

(60) Provisional application No. 61/675,635, filed on Jul. 25, 2012.

(51) Int. Cl.

| | |
|---|---|
| ***E06C 1/04*** | (2006.01) |
| ***E06C 1/10*** | (2006.01) |
| ***E06C 1/38*** | (2006.01) |
| ***E06C 7/18*** | (2006.01) |
| *E06C 1/12* | (2006.01) |

(52) U.S. Cl.

CPC ... *E06C 1/04* (2013.01); *E06C 1/10* (2013.01); *E06C 1/381* (2013.01); *E06C 7/188* (2013.01); *E06C 1/125* (2013.01)

(58) Field of Classification Search

CPC ..... A01M 31/02; E06C 1/02; E06C 1/00; E06C 1/04; E06C 1/08; E06C 1/10; E06C 1/12; E06C 1/34; E06C 1/38; E06C 1/381; E06C 7/00; E06C 7/50; E06C 7/505

USPC ..... 182/189, 187, 178.3, 178.5, 93, 95, 97, 182/100, 129

See application file for complete search history.

(56) References Cited

U.S. PATENT DOCUMENTS

| | | | | | |
|---|---|---|---|---|---|
| 159,126 | A | * | 1/1875 | Van Zandt | 182/24 |
| 907,483 | A | | 12/1908 | Ette | |
| 1,270,158 | A | | 6/1918 | Hill | |
| 1,719,997 | A | * | 7/1929 | Pirsch | 182/156 |
| 1,748,673 | A | | 2/1930 | Hurst | |
| 1,953,298 | A | * | 4/1934 | Goodwin | 182/91 |
| 2,052,439 | A | * | 8/1936 | Bailey | 182/189 |
| 2,148,099 | A | * | 2/1939 | Bray | 182/156 |
| 2,680,593 | A | * | 6/1954 | McIntyre | 182/231 |

(Continued)

OTHER PUBLICATIONS

Exhibit A includes photos of various "climbing sticks," at least three of which ("Ameristep", "Muddy Outdoors," and "Gorilla") are believed to have been on sale more than one year prior to the filing date of this application.

(Continued)

*Primary Examiner* — Katherine Mitchell
*Assistant Examiner* — Shiref Mekhaeil
(74) *Attorney, Agent, or Firm* — Gardner, Linn, Burkhart & Flory, LLP

(57) ABSTRACT

A climbing support is provided for aiding a climber in scaling a tree, pole, or other generally vertical surface. The climbing support includes an elongate body that supports a plurality of steps, a strap, cable, or other flexible securing member that is wrapped around the tree, and a retractor for stowing the flexible securing member so that it is extendable and retractable from the support. The climbing support is thus substantially self-contained so that it does not require separate components for installation or use. Standoffs may be provided for stabilizing the support in a location spaced from the tree. Optionally, the climbing support's steps, standoffs, and elongate body are collapsible to compact configurations for stowage or transport.

16 Claims, 20 Drawing Sheets

(56) References Cited

U.S. PATENT DOCUMENTS

| | | | | | |
|---|---|---|---|---|---|
| 3,019,851 | A * | 2/1962 | Doss | 182/111 |
| 3,148,857 | A * | 9/1964 | Hutchison | 248/247 |
| 3,233,591 | A * | 2/1966 | Rogers et al. | 119/796 |
| 3,493,079 | A * | 2/1970 | Dudschus | 182/141 |
| 3,596,736 | A * | 8/1971 | Crawford | 182/148 |
| 3,891,273 | A * | 6/1975 | Takada | 297/476 |
| 4,061,306 | A * | 12/1977 | Taylor | 248/523 |
| 4,132,288 | A * | 1/1979 | Bingham | 182/156 |
| 4,413,706 | A * | 11/1983 | Michael | 182/91 |
| 4,415,061 | A | 11/1983 | Meyer | |
| 4,432,436 | A * | 2/1984 | Suiter | 182/97 |
| 4,542,805 | A * | 9/1985 | Hamlin et al. | 182/91 |
| 4,669,575 | A * | 6/1987 | Skyba | 182/92 |
| 4,719,990 | A * | 1/1988 | Markovic | 182/163 |
| 4,867,272 | A | 9/1989 | Troubridge | |
| 4,877,110 | A * | 10/1989 | Wolner | 182/232 |
| 5,040,635 | A * | 8/1991 | Strickland | 182/100 |
| 5,242,030 | A * | 9/1993 | Lobozzo | 182/187 |
| 5,253,732 | A * | 10/1993 | Daniels | 182/116 |
| 5,267,632 | A * | 12/1993 | Mintz | 182/116 |
| 5,279,388 | A | 1/1994 | Laughlin et al. | |
| 5,655,623 | A * | 8/1997 | Skyba | 182/116 |
| 5,743,353 | A | 4/1998 | Browning et al. | |
| 5,779,001 | A * | 7/1998 | Skyba | 182/107 |
| 6,170,609 | B1 * | 1/2001 | Dech | 182/187 |
| 6,311,918 | B1 * | 11/2001 | Specht | 242/382 |
| 6,334,508 | B1 * | 1/2002 | Shields | 182/116 |
| 6,340,071 | B1 * | 1/2002 | Diekemper | 182/100 |
| 6,439,343 | B1 | 8/2002 | Jorges et al. | |
| 6,484,981 | B1 * | 11/2002 | Perrault | 248/218.4 |
| 6,547,035 | B1 * | 4/2003 | D'Acquisto | 182/100 |
| 6,595,325 | B2 * | 7/2003 | Ulrich | 182/136 |
| 6,668,975 | B2 * | 12/2003 | Skipper | 182/100 |
| 6,782,840 | B1 * | 8/2004 | Garelick et al. | 114/362 |
| 7,246,683 | B2 * | 7/2007 | Pringnitz | 182/187 |
| 7,258,045 | B2 | 8/2007 | Smith | |
| 7,584,940 | B2 * | 9/2009 | Gee | 254/238 |
| 7,882,931 | B2 * | 2/2011 | D'Acquisto | 182/187 |
| 8,556,035 | B1 * | 10/2013 | Kendall et al. | 182/156 |
| 8,684,390 | B1 * | 4/2014 | Barrette | 280/480.1 |
| 8,695,762 | B1 * | 4/2014 | Carter et al. | 182/187 |
| 2004/0031898 | A1 * | 2/2004 | Mijatovic | 248/330.1 |
| 2004/0035637 | A1 * | 2/2004 | Skipper | 182/92 |
| 2005/0217937 | A1 * | 10/2005 | Rohlf | 182/232 |
| 2007/0256892 | A1 * | 11/2007 | Breedlove | 182/116 |
| 2008/0156588 | A1 * | 7/2008 | Butcher | 182/200 |
| 2008/0196972 | A1 * | 8/2008 | Bell | 182/92 |
| 2009/0045012 | A1 | 2/2009 | Menel | |
| 2009/0178887 | A1 * | 7/2009 | Reeves et al. | 182/239 |
| 2013/0161127 | A1 * | 6/2013 | Allred et al. | 182/108 |
| 2013/0299275 | A1 * | 11/2013 | Westermann et al. | 182/3 |

OTHER PUBLICATIONS

Commonly-owned U.S. Appl. No. 13/275,408, filed Oct. 18, 2011.

* cited by examiner

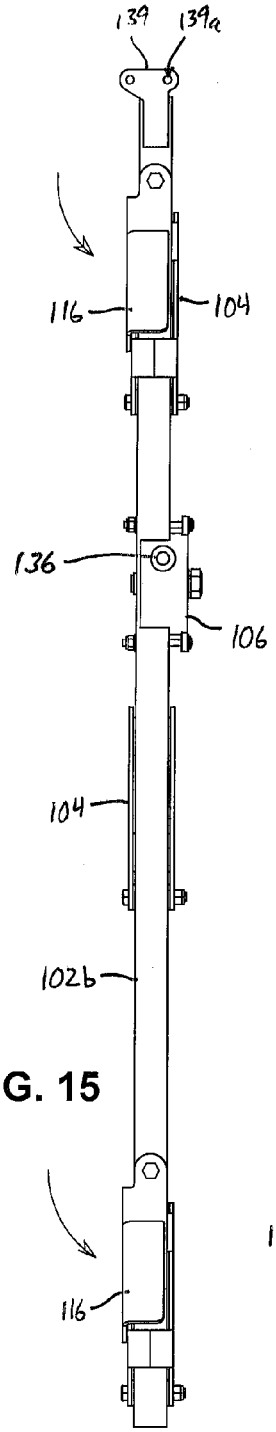
FIG. 15
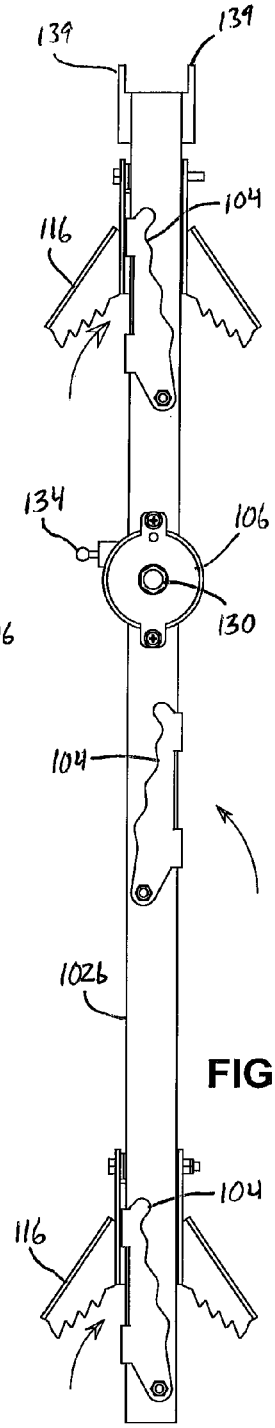
FIG. 16
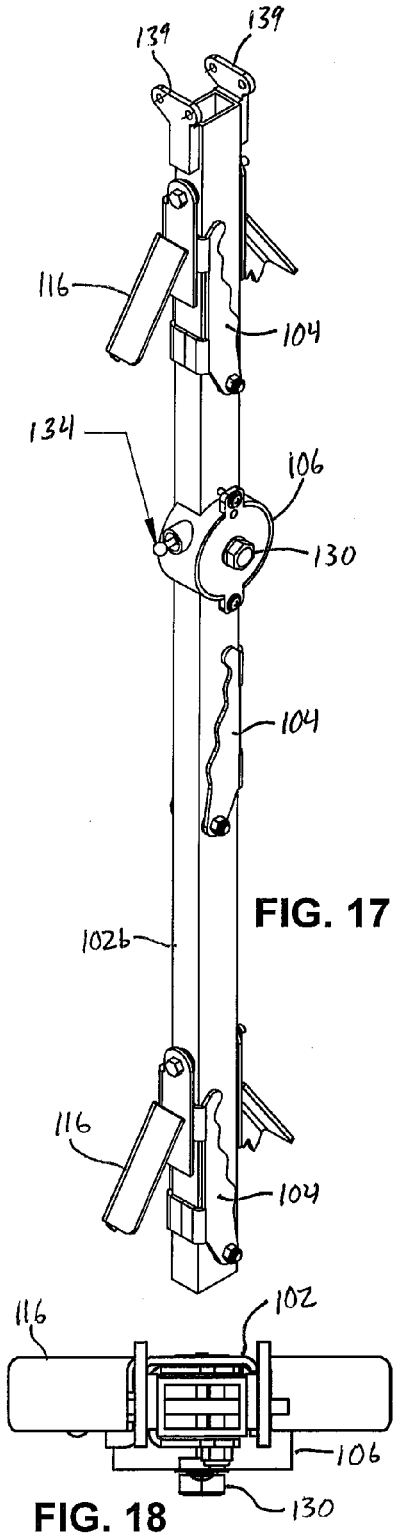
FIG. 17
FIG. 18

TREE CLIMBING SUPPORT

CROSS REFERENCE TO RELATED APPLICATION

The present application claims the priority benefit of U.S. provisional application, Ser. No. 61/675,635, filed Jul. 25, 2012, which is hereby incorporated herein by reference in its entirety.

FIELD OF THE INVENTION

The present invention is directed to climbing apparatuses, and more particularly, to ladder-like supports for attachment to trees, poles, and the like.

BACKGROUND OF THE INVENTION

The ability to safely and efficiently climb or scale trees, poles such as telephone or powerline poles, and similar structures or surfaces is useful for reaching elevated hunting blinds, servicing utility wires, and the like. Although ladder-like "climbing sticks" are sometimes used for climbing, these are typically tied or strapped to trees or poles using loose ropes or straps, and are generally bulky and time consuming to install and remove.

SUMMARY OF THE INVENTION

The present invention provides a climbing support or apparatus that can be readily configured between a "use" configuration and a more compact "transport" configuration, and that can be readily installed and removed by one person. The climbing support can be configured in a stowage or transport configuration that is substantially more compact than the use configuration, so that several climbing supports can be carried at once by a single user. One or more retractors that are included on the climbing support provide convenient stowage of securing cables, straps, or the like when the assemblies are not in use, thus avoiding tangles or knots that are more likely to occur if the cables or straps are not stored in an organized fashion. Once the climbing support is secured to a tree or the like, steps are provided which may be used as hand-holds and/or foot-holds as a climber scales the support.

In one form of the present invention, a climbing support is provided for use in climbing a tree or pole, and includes an elongate body, a step member, a flexible elongate securing member, and a retractor. The step member extends or projects outwardly from the elongate body, and provides a hand-hold and/or foot support for a user. The flexible elongate securing member, which may optionally be a rope, a cord, a cable, a strap, a chain, or the like, or a combination thereof, is coupled to the elongate body, with at least a portion of the securing member being selectively extendable from the elongate body. The securing member can be wrapped around a tree or pole in order to attach the climbing support to the tree or pole, and the securing member is retractable at the elongate body for compact storage or transport when the securing member is not in use. The retractor is positioned at or along the elongate body, and is configured to store at least a portion of the securing member, while also permitting the securing member to be selectively extended and retracted relative to the elongate body.

In one aspect, the retractor includes a spool for selectively winding and unwinding the securing member between retracted and extended configurations. Optionally, the retractor includes a lock member for selectively securing the spool against rotation. The retractor may further include one or more of (i) a tool-engaging head to facilitate manual rotation of the spool with a tool, (ii) a spring configured to bias the spool to rotate for winding the securing member onto the spool, and (iii) a ratcheting mechanism for securing the spool against unintended unwinding of the securing member.

In another aspect, the retractor includes a tensioning pulley about which the securing member is wound. The tensioning pulley is translatable relative to the elongate body to thereby adjust tension or slack in the securing member. Optionally, the retractor further includes a substantially non-translatable pulley coupled to the elongate body and spaced from the tensioning pulley, and wherein the securing member is wound at least partially around the non-translatable pulley.

In still another aspect, the securing member includes a first end portion fixedly secured to the elongate body, a second end portion that is extendable and retractable relative to the elongate body, and a middle portion between the first and second end portions. The middle portion of the securing member extends from the first end portion, wraps around the tensioning pulley, wraps around the non-translatable pulley, and extends outwardly from the elongate body where the securing member is terminated at the second end portion.

In a further aspect, the retractor and at least a portion of the securing member are positioned inside of the elongate body, and the elongate body includes a generally tubular structure having an internal elongate divider wall to which the first end portion of the securing member and the non-translatable pulley are coupled. Optionally, the generally tubular structure of the elongate body further includes at least one outer wall spaced outwardly from the divider wall and defines an elongate channel for translatably supporting the tensioning pulley.

In a still further aspect, the tensioning pulley includes a shaft having a grasping end portion that projects outwardly from the elongate body, and a lock end portion opposite the grasping end portion. The shaft is axially movable between an unlocking position and a locking position, and the divider wall of the elongate body includes a plurality of bores in longitudinally-spaced arrangement for selectively receiving the lock end portion of the tensioning pulley in the locking position to thereby selectively secure the tensioning pulley against translation relative to the elongate body.

In yet another aspect, the step member is pivotably coupled to the elongate body, and is pivotable between an outwardly-extending position for use as a hand-hold or foot support, and a retracted position for compact stowage along the elongate body.

In another aspect, the climbing support further includes a standoff member pivotably coupled to the elongate body and configured to engage the tree or pole and to maintain a space between the elongate body and the tree or pole when the securing member is wrapped around the tree or pole. The standoff member is repositionable between a substantially horizontal orientation for engaging the tree or pole, and a substantially vertical orientation along the elongate body for compact stowage and transport.

In still another aspect, the elongate body includes an attachment element for selectively receiving and retaining a distal end portion of the securing member when the securing member is extended from the elongate body and wrapped around the tree or pole.

Optionally, the climbing support may include at least two climbing support subassemblies that are configured to be arranged end-to-end. Each of the subassemblies includes at least one of the elongate bodies and at least one of each of (i) the step members, (ii) the securing members, and (iii) the retractors. Optionally, a first of the climbing support subassemblies includes a first engaging member at a lower end thereof, a second of the climbing support subassemblies includes a second engaging member at an upper end thereof, and the first and second climbing support subassemblies are securable to one another via engagement of the first and second engaging members. Optionally, the first engaging member includes a post extending downwardly from the elongate body of the first climbing support subassembly, and the second engaging member includes an opening in the elongate body of the second climbing support subassembly. Optionally, a lock pin is provided for selectively securing the first and second engaging members together, with the first and second engaging members including respective bores that align to receive the lock pin.

In a further aspect, the elongate body includes an upper body portion pivotably coupled to a lower body portion via a hinge. The elongate body is configurable between a compact configuration in which the upper body portion is positioned alongside the lower body portion in substantially parallel arrangement, and an extended configuration in which the upper body portion is positioned substantially in-line with the lower body portion. Optionally, the hinge includes a lock element configured to selectively secure the elongate body in the extended configuration.

In another form of the present invention, a climbing support includes an elongate body with an upper body portion that is pivotably coupled to a lower body portion via a hinge, a step member that extends outwardly from the elongate body, and a standoff member that is coupled to the elongate body. The standoff member is configured to engage the tree or pole and to maintain a space between the elongate body and the tree or pole. The elongate body is configurable between a compact configuration in which the upper body portion is positioned adjacent the lower body portion, and an extended configuration in which the upper body portion is positioned substantially in-line with the lower body portion.

Thus, the climbing support of the present invention provides a strong, secure, and stable climbing support for use in scaling trees, poles, or the like, but which may be quickly and easily reconfigured to a self-contained and compact stowed configuration that is readily transported in a vehicle or by a person.

These and other objects, advantages, purposes, and features of the invention will become more apparent upon review of the following specification in conjunction with the drawings.

BRIEF DESCRIPTION OF THE DRAWINGS

FIG. 15 is a left side elevation of the lower subassembly portion of FIG. 11, shown in the collapsed transport configuration;

FIG. 16 is a front elevation of the lower subassembly portion of FIG. 15;

FIG. 17 is a perspective view of the lower subassembly portion of FIG. 15;

FIG. 18 is a top plan view of the lower subassembly portion of FIG. 15;

DESCRIPTION OF THE PREFERRED EMBODIMENTS

Figure 1:
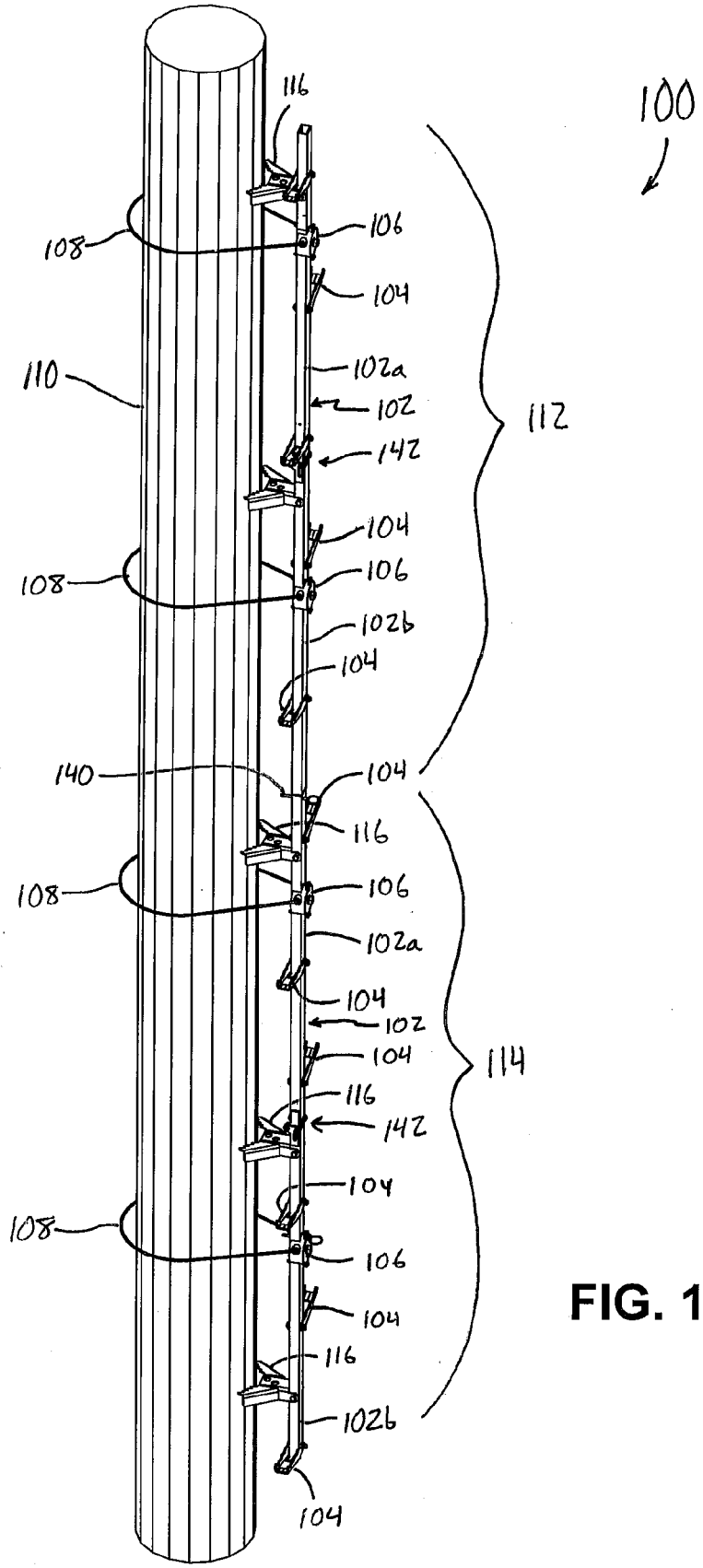
FIG. 1 is a perspective view of a climbing support assembly in accordance with the present invention, shown attached to a tree or pole.
Figure 5:
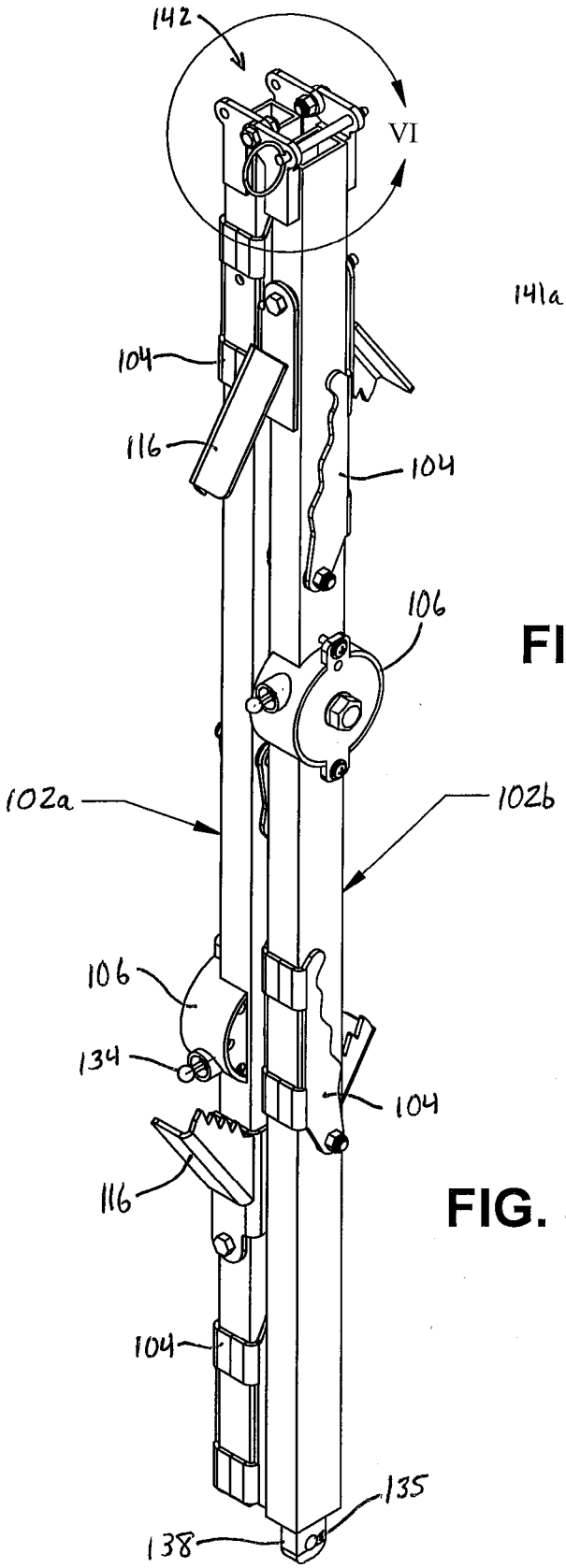
FIG. 5 is a perspective view of the upper subassembly of FIG. 4, shown in a collapsed transport configuration.
Figure 9:
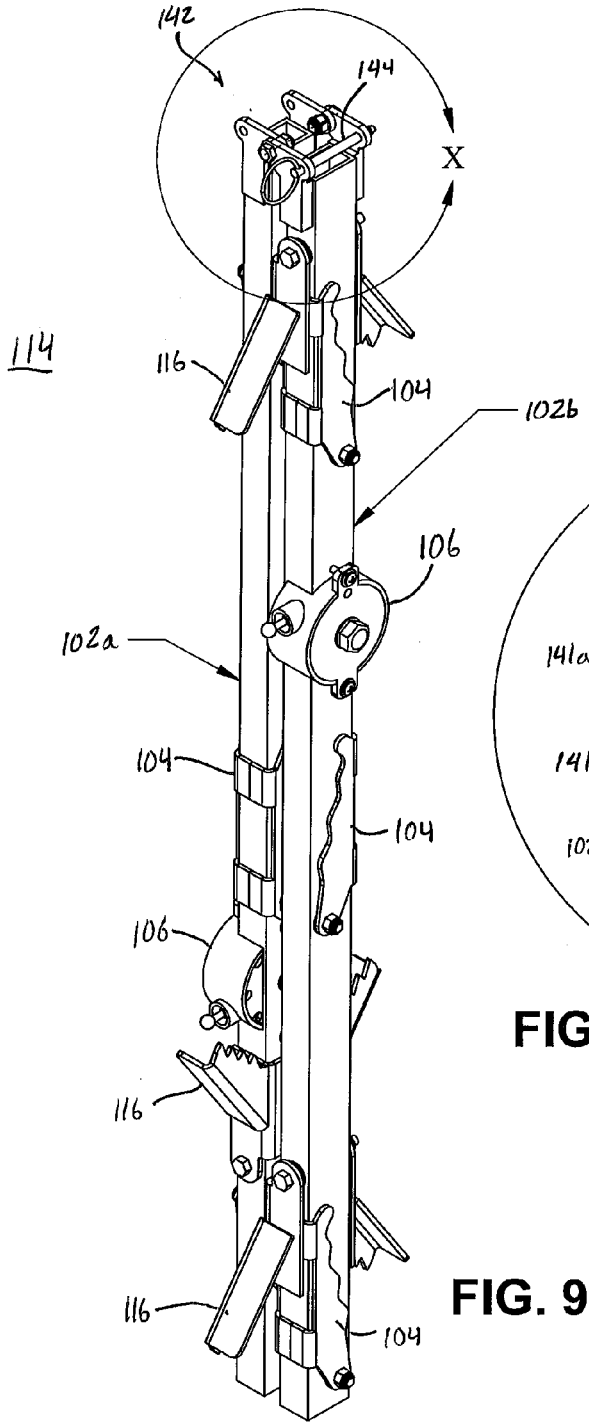
FIG. 9 is a perspective view of the lower subassembly of FIG. 7, shown in a collapsed transport configuration.

Referring now to the drawings and the illustrative embodiments depicted therein, a climbing support assembly 100, which may also be referred to as a "climbing stick," includes a main frame member in the form of an elongate body 102, a plurality of steps or step members 104, a retractor 106, and a cable, cord, strap, or other flexible securing member 108 for selectively securing climbing support assembly 100 to a tree or pole 110 or the like, including substantially any vertical or generally vertical object or surface, such as shown in FIG. 1. Climbing support assembly 100 is configurable between an extended "use" configuration (FIGS. 1 and 2) in which the support assembly may be secured to a tree via flexible securing member 108, which is extendable and retractable on the retractor for that purpose, and a storage or transport configuration (FIGS. 5 and 9) in which the support assembly is considerably more compact. To simplify the remaining description, the term "tree" will be used hereafter to refer to any tree or pole, although it will be appreciated that other objects or surfaces are envisioned.

Figure 2:
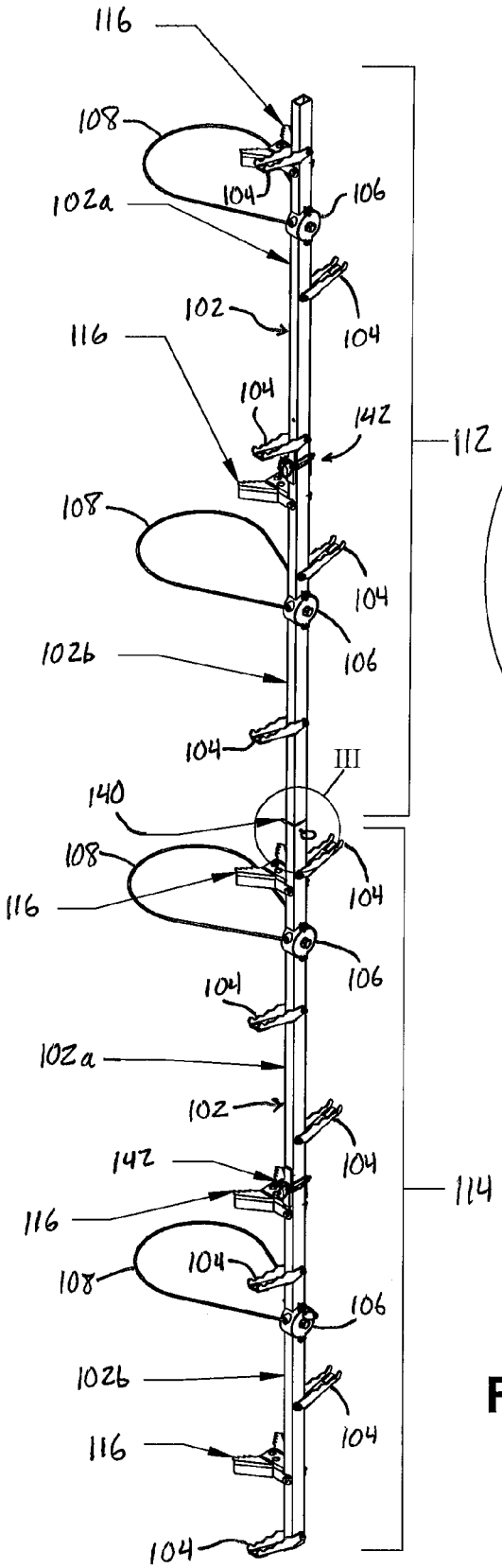
FIG. 2 is another perspective view of the climbing support of FIG. 1.
Figure 23:
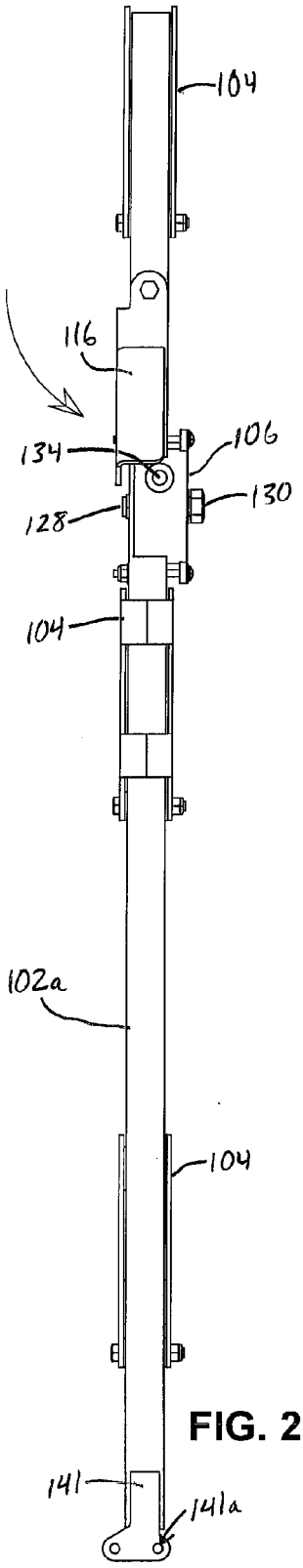
FIG. 23 is a left side elevation of the upper subassembly portion of FIG. 22, shown in the collapsed transport configuration.
Figure 24:
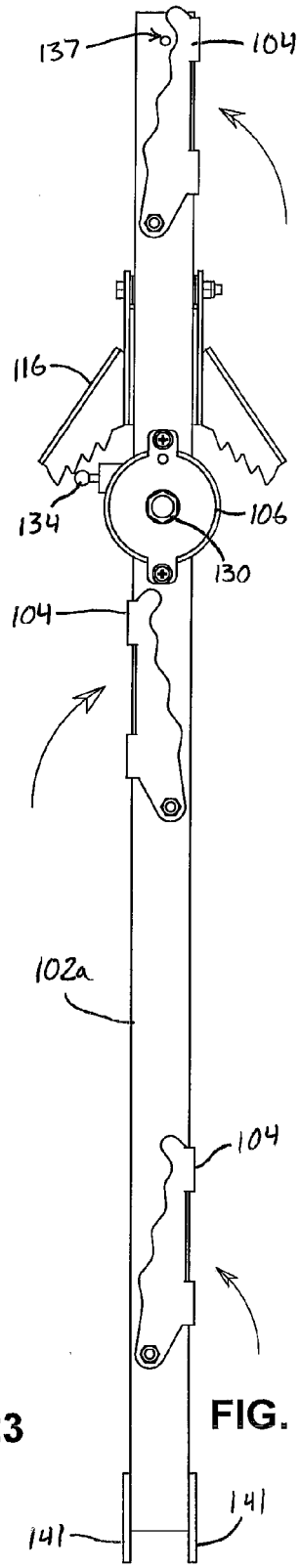
FIG. 24 is a front side elevation of the upper subassembly portion of FIG. 23.
Figure 25:
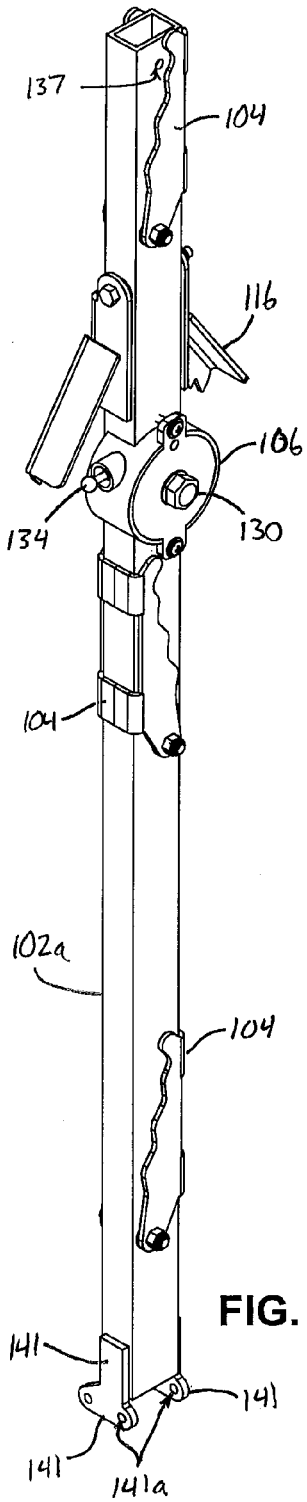
FIG. 25 is a perspective view of the upper subassembly portion of FIG. 23.
Figure 26:
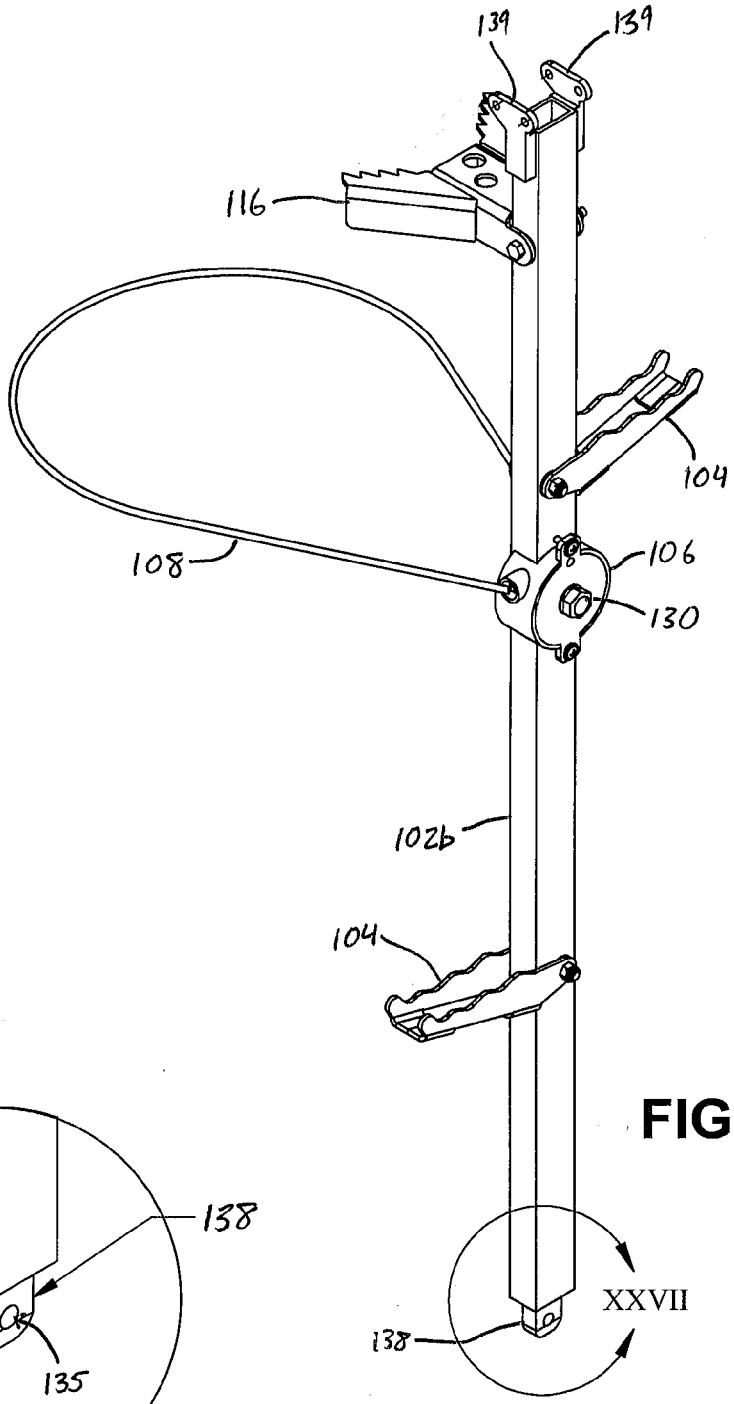
FIG. 26 is a perspective view of a lower portion of the upper subassembly of FIG. 4.
Figure 27:
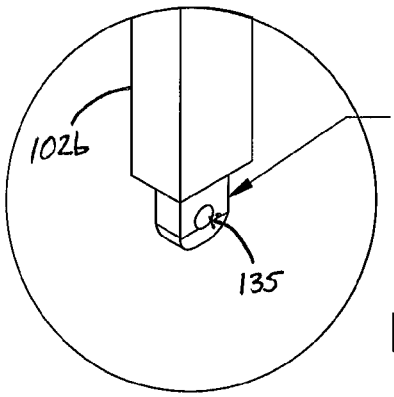
FIG. 27 is an enlarged view of the region designated XXVII in FIG. 26.
Figure 28:
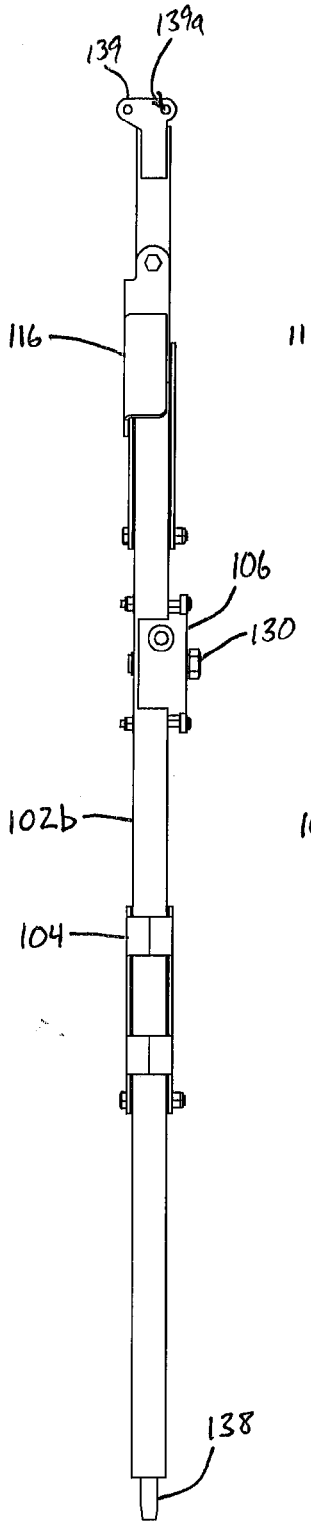
FIG. 28 is a left side elevation of the lower subassembly portion of FIG. 26, shown in the collapsed transport configuration.
Figure 29:
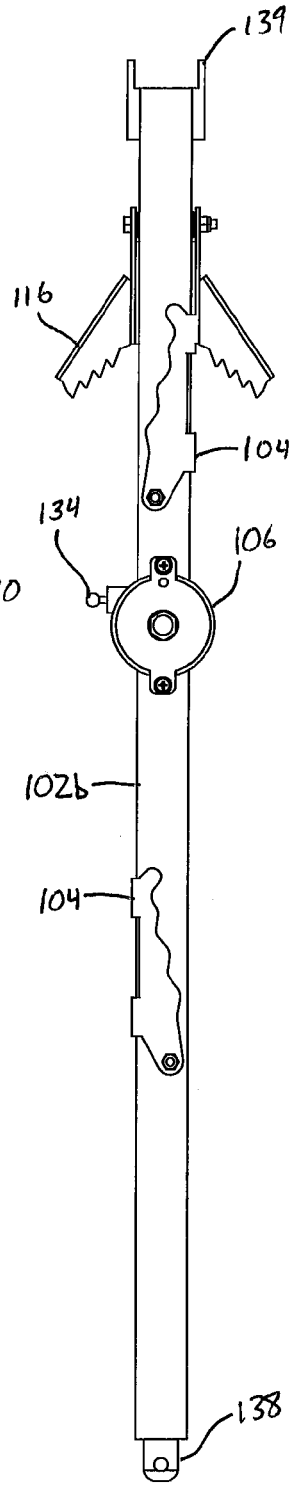
FIG. 29 is a front side elevation of the lower subassembly portion of FIG. 28.
Figure 30:
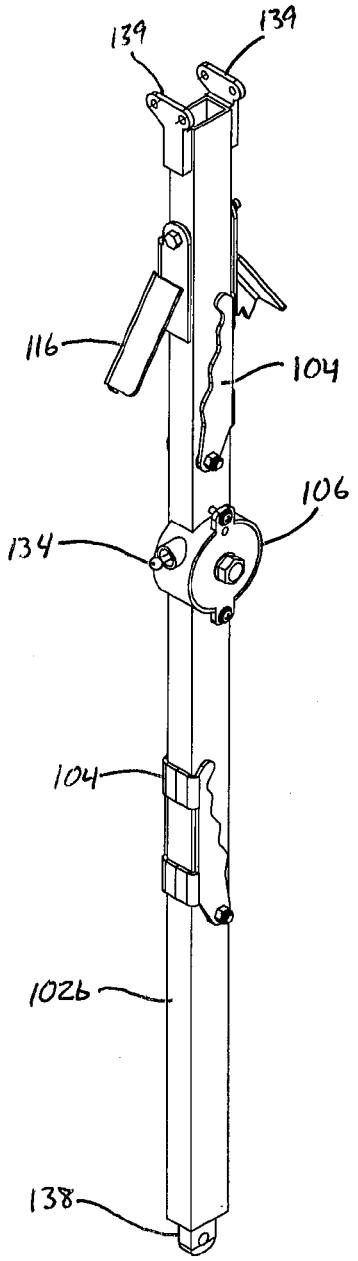
FIG. 30 is a perspective view of the lower subassembly portion of FIG. 28.
Figure 31:
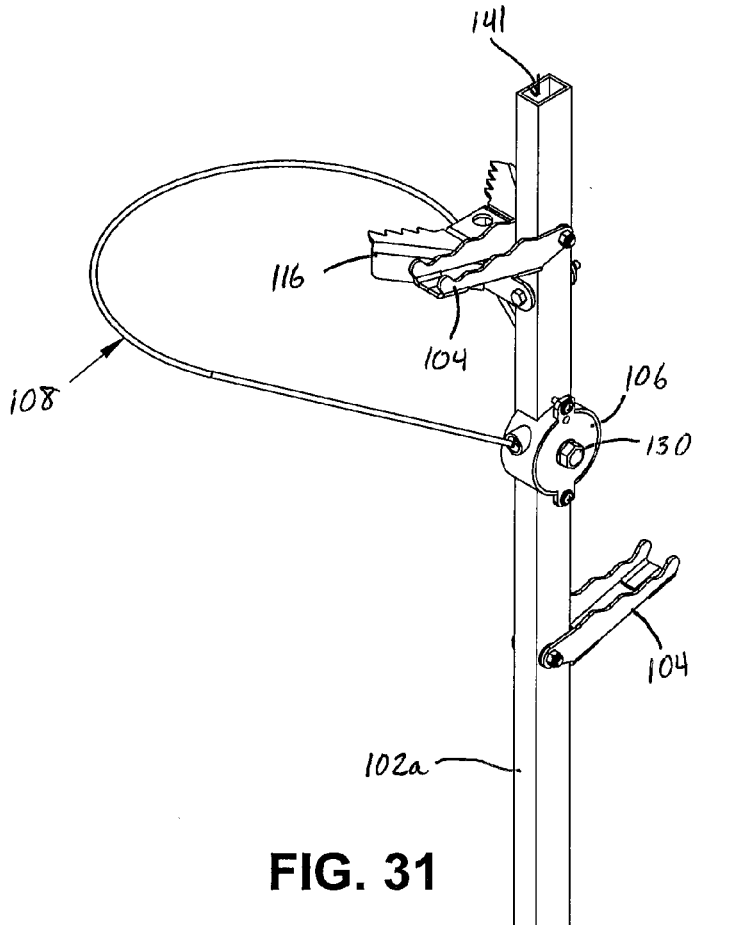
FIG. 31 is a perspective view of an upper portion of the upper subassembly of FIG. 4.
Figure 32:
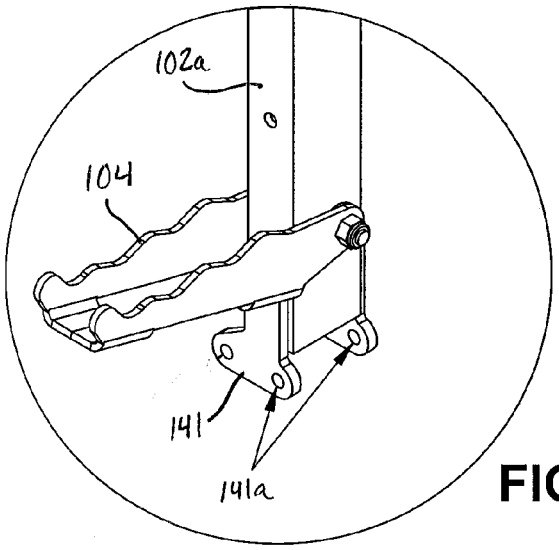
FIG. 32 is an enlarged view of the region designated XXXII in FIG. 31.
Figure 33:
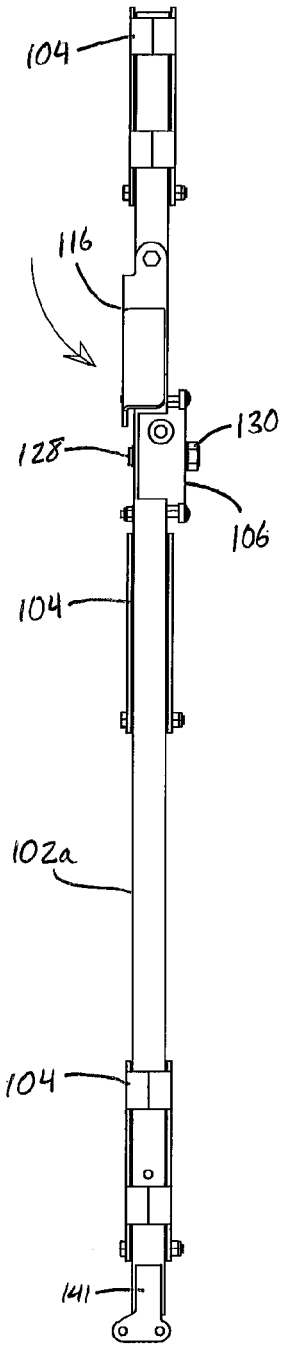
FIG. 33 is a left side elevation of the upper subassembly portion of FIG. 31, shown in the collapsed transport configuration.
Figure 34:
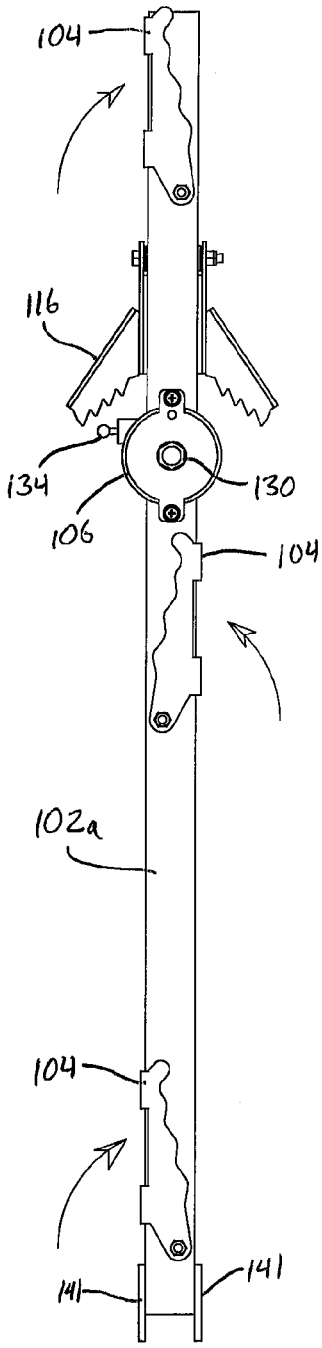
FIG. 34 is a front side elevation of the upper subassembly portion of FIG. 33.
Figure 35:
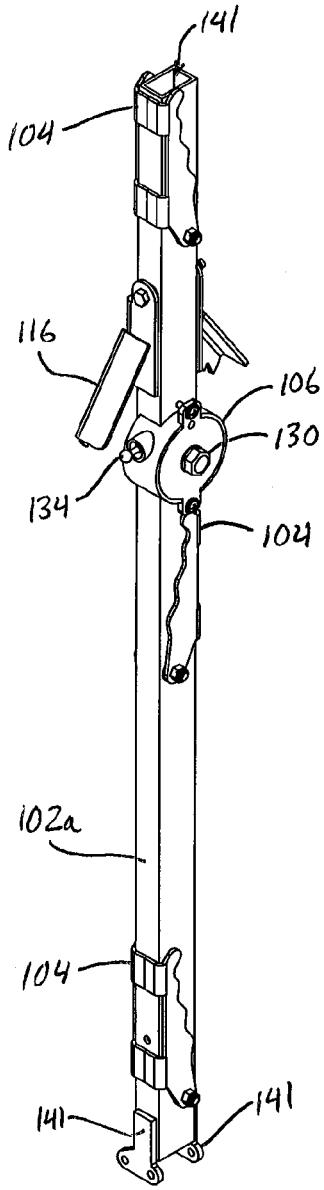
FIG. 35 is a perspective view of the upper subassembly portion of FIG. 33.
Figures 36, 37, 38, 39, 40:
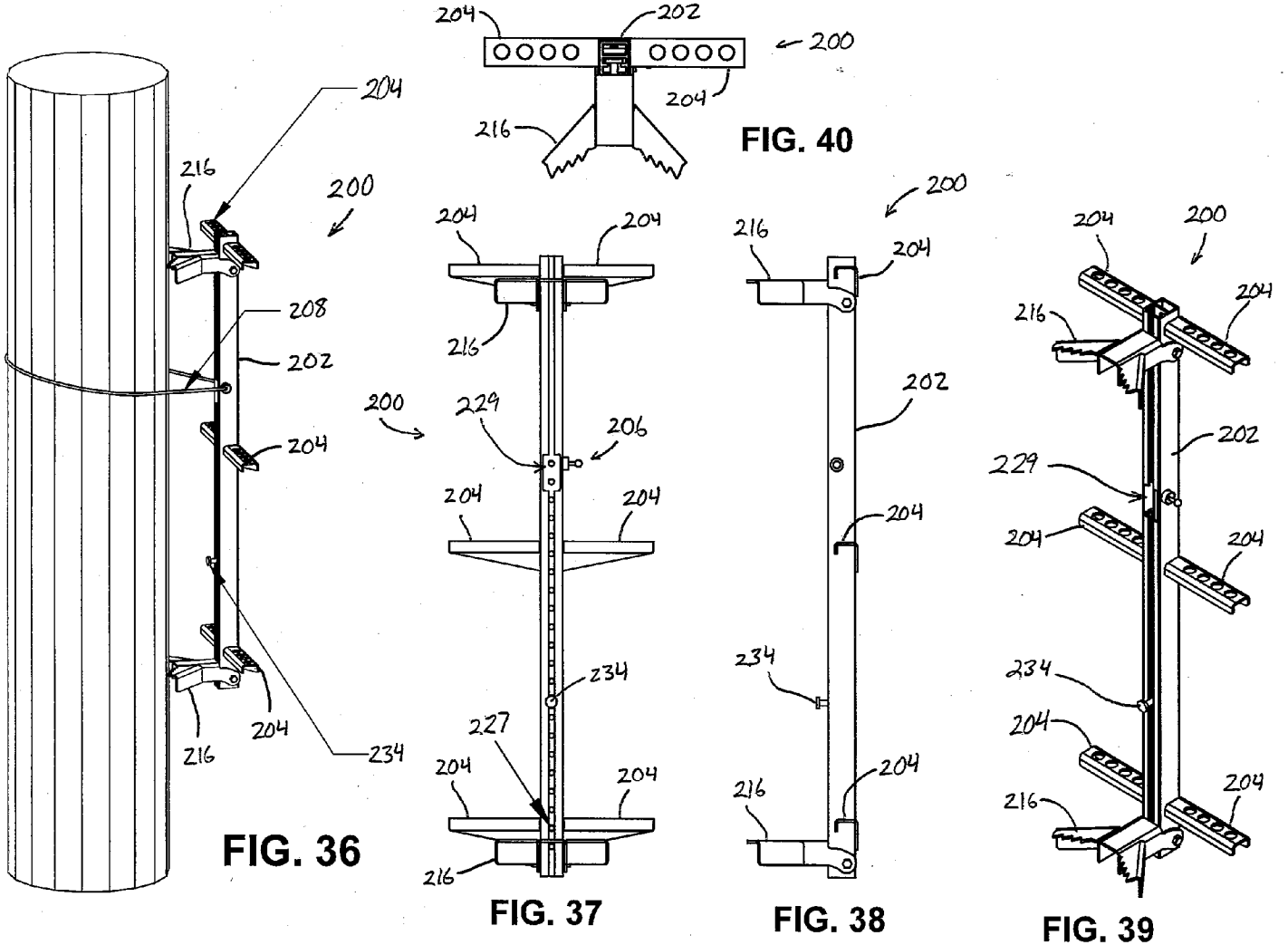
FIG. 36 is a perspective view of another climbing support assembly in accordance with the present invention, shown attached to a tree or pole.
FIG. 37 is a rear elevation of the climbing support of FIG. 36.
FIG. 38 is a left side elevation of the climbing support of FIG. 36.
FIG. 39 is a rear perspective view of the climbing support of FIG. 36.
FIG. 40 is a top plan view of the climbing support of FIG. 36.

In the illustrated embodiment, climbing support assembly 100 includes an upper climbing support subassembly 112 and a lower climbing support subassembly 114 that can be coupled together in series at their respective elongate bodies 102, such as shown in FIGS. 1 and 2. Each climbing support subassembly 112, 114 includes a plurality of standoffs or "offsets" 116 that are positionable so as to project or extend perpendicularly outwardly from each elongate body 102 and engage the tree 110, to provide adequate room between the tree 110 and the steps 104 and elongate body 102, and so that a user can readily grasp these components of the climbing support assembly with the hands and place a foot solidly on each step 104. Standoffs 116 are pivotably coupled to the elongate bodies 102 and are repositionable between a substantially horizontal orientation for engaging the tree or pole 110 (FIGS. 1 and 2), and a substantially vertical orientation along the elongate body 102 for compact stowage and transport (FIGS. 5, 9, 15-18, 23-25, 28-30, and 33-35). In the illustrated embodiment, and as shown with curved arrows in FIGS. 15, 23, and 33, standoffs 116 pivot downwardly from the horizontal orientation to the vertical (stowed) configuration, and cannot pivot upwardly beyond the horizontal orientation. This allows the standoffs 116 to work in concert with flexible securing members 108 to support the weight of support assembly 100 and a user (position thereon) along the tree 110, as will be described in more detail below.

Similar to the standoffs 116, the steps 104 are pivotably coupled to the elongate body 102 between an outwardly-extending position for use as a hand-hold or foot support (FIGS. 1 and 2), and a retracted position for compact stowage along the elongate body 102 (FIGS. 5, 9, 15-18, 23-25, 28-30, and 33-35). Steps 104 are generally U-shaped in cross section, and define an opening that faces upwardly when the steps are deployed to the outwardly-extending position, and that faces inwardly to receive a portion of elongate body 102 in the compact stowage position. Steps pivot upwardly from the outwardly-extending position to the compact stowage position, such as shown with curved arrows in FIGS. 16, 24, and 34, and cannot pivot downwardly beyond the outwardly-extending position, which permits the steps to support substantial weight when they are deployed.

Figure 14:
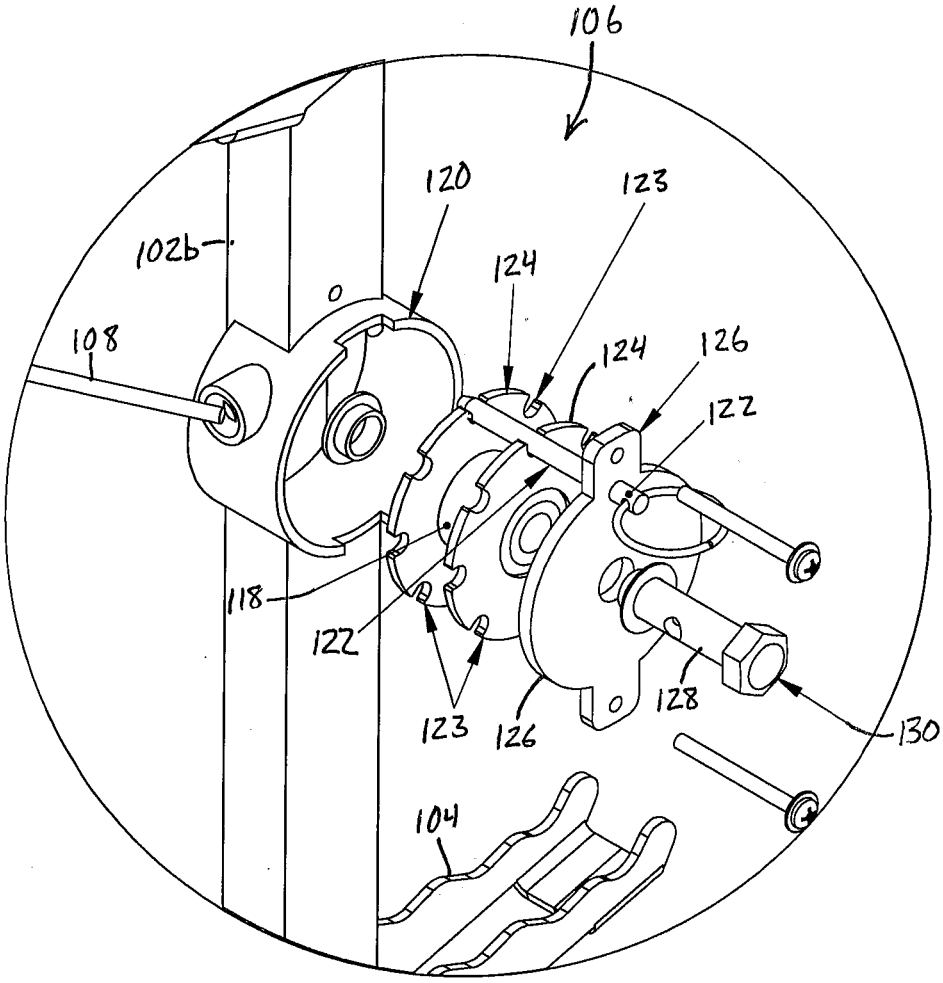
FIG. 14 is an enlarged view of the region designated XIV in FIG. 13.

Retractor 106 includes a spool 118 (FIG. 14) for selectively winding and unwinding the flexible securing member 108 between retracted and extended configurations. In the illustrated embodiment, retractor 106 is received in a cut-away portion of elongate body 102, and includes an outer casing or housing 120 that may be welded to elongate body 102, or attached in a different manner, so that outer casing 120 provides structural support in place of the cut-away portion of elongate body 102. Retractor 106 includes a lock member or pin 122 for selectively securing the spool 118 against rotation by engaging slots or openings 123 formed or established in circular plates 124 on either end of spool 118, while also engaging holes formed in a retractor cover plate 126 and in a rear surface of elongate body 102 (FIG. 14). Optionally, it is envisioned that the retractor could be coupled to the outside of elongate body 102, thereby negating the potential loss of structural strength of removing a portion of the elongate body, or the retractor could be incorporated directly into the elongate body, without departing from the spirit and scope of the present invention. It is further envisioned that different types of retractors may be used, such as spring-loaded self-rewinding retractors, for example.

Figure 12:
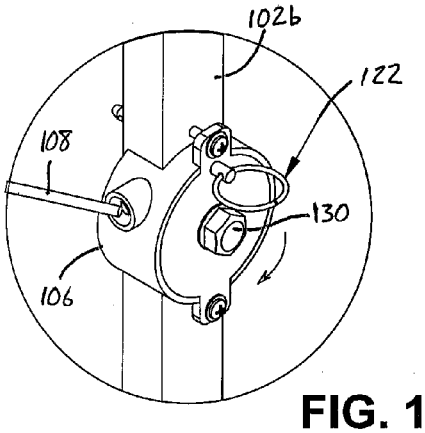
FIG. 12 is an enlarged view of the region designated XII in FIG. 11.
Figure 21:
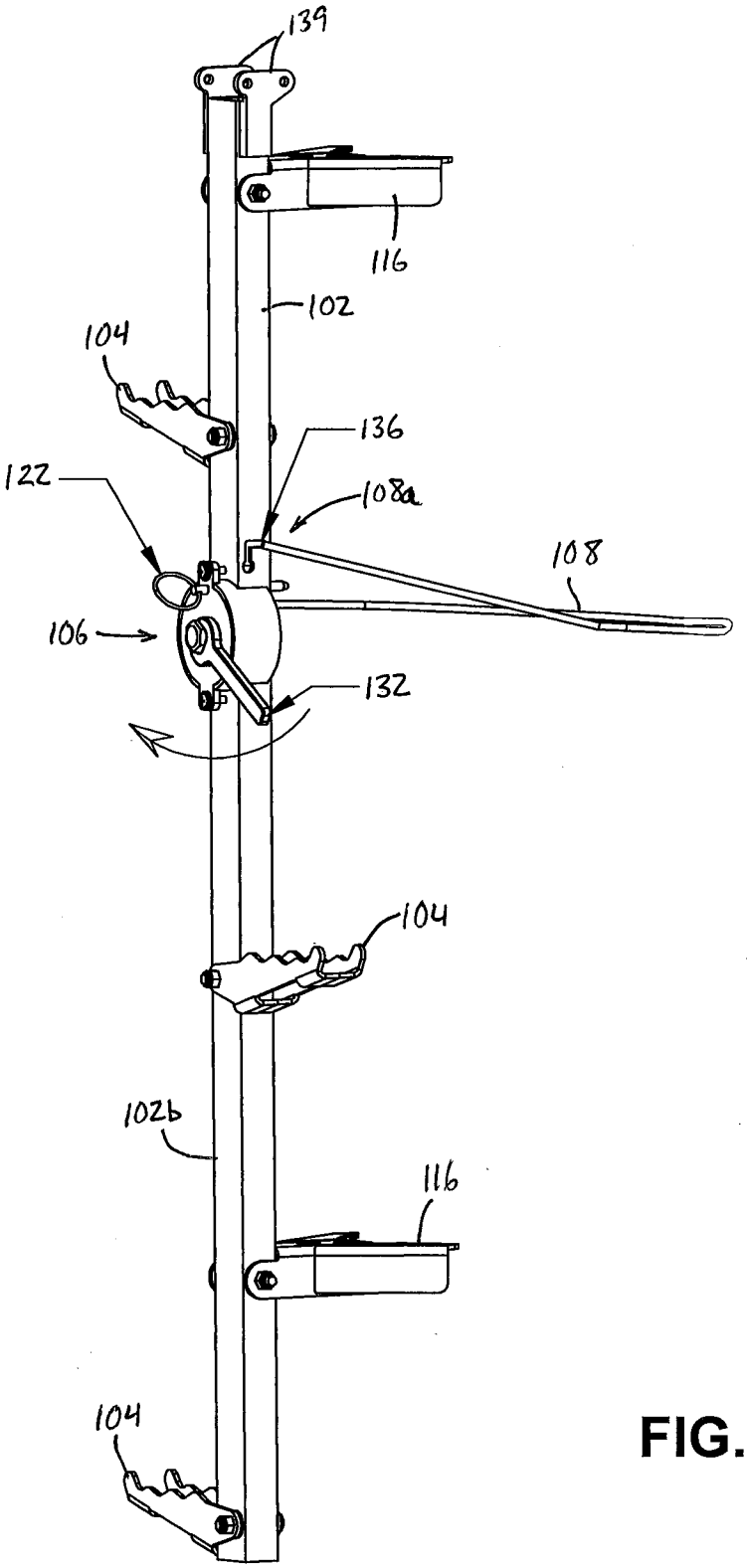
FIG. 21 is a rear perspective view of the lower subassembly portion of FIG. 19, showing a subsequent step of securing the cable end for attaching the assembly to a tree or pole.
Figure 22:
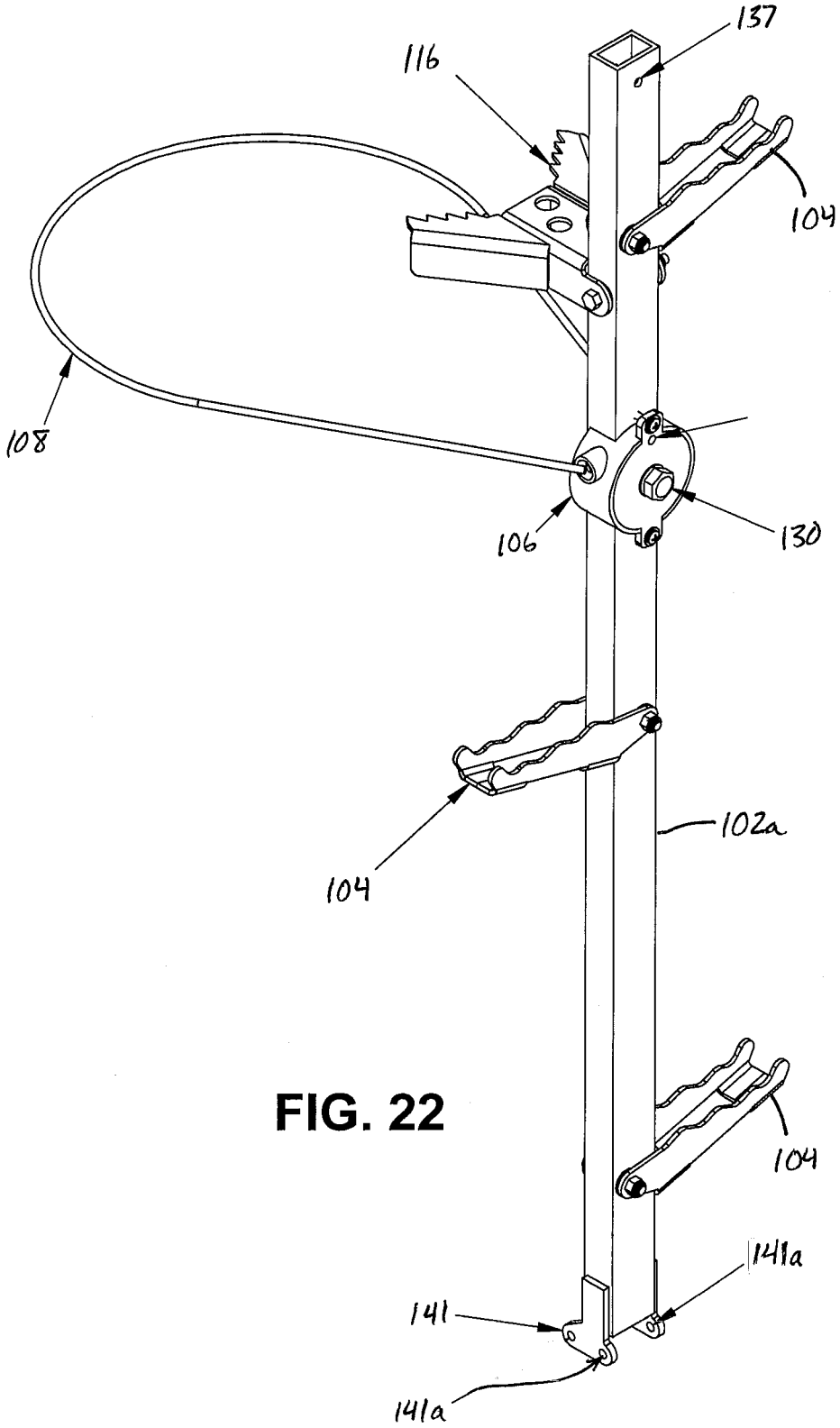
FIG. 22 is a perspective view of an upper portion of the lower subassembly of FIG. 7.

Retractor 106 includes a spindle 128 that extends through spool 118 and rotates with the spool, relative to casing 120 and elongate body 102, and includes a tool-engaging head portion 130 (FIG. 14) to facilitate manual rotation of the spool 118 with a tool such as a wrench 132 or the like (FIGS. 12 and 21). Optionally, a winding handle may be permanently attached to the retractor spindle, similar to the crank arm associated with a screw fastener that is shown and described in commonly-owned U.S. patent application Ser. No. 13/275,408, filed Oct. 18, 2011, and entitled TREE CLIMBING SUPPORT, which is hereby incorporated herein by reference in its entirety. Optionally, it is envisioned that other types of retractors could be used, such as automatic winding retractors including a spring for biasing the spool to rotate in a manner that winds and tensions the flexible securing member onto the spool, and/or including a ratcheting mechanism for securing the spool against unintended unwinding of the flexible securing member. Retractor 106 may be configured to operate with substantially any type of flexible securing member 108, such as a rope, cord, cable, strap, chain, or the like, or a combination of those.

Figure 19:
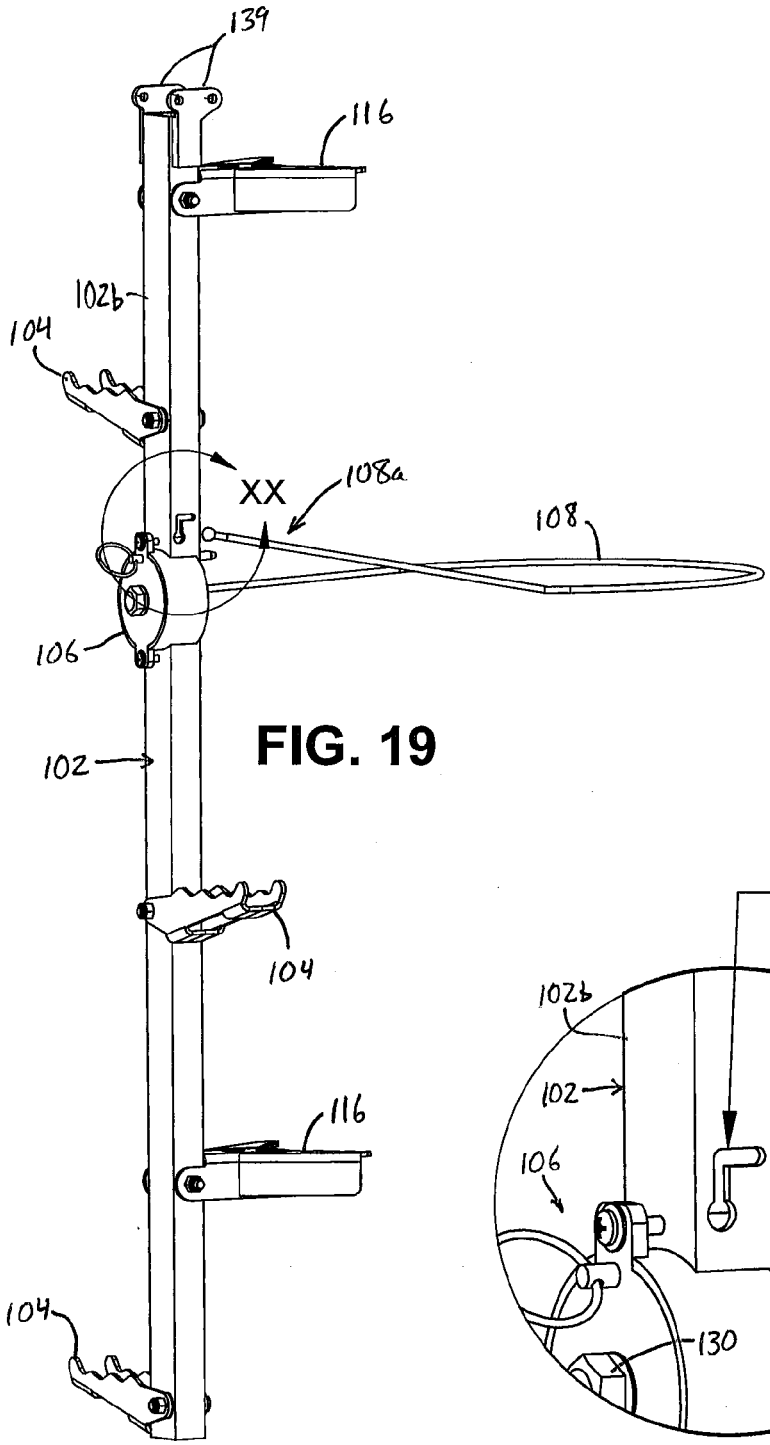
FIG. 19 is a rear perspective view of the lower subassembly portion of FIG. 11, showing a step of extending a cable for use in securing the assembly to a tree or pole.
Figure 20:
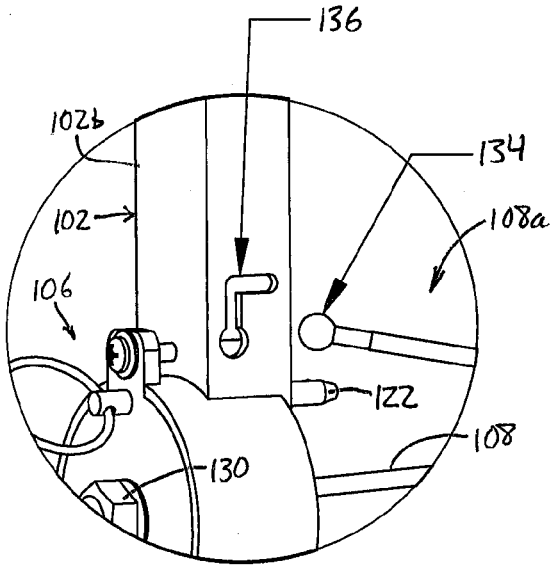
FIG. 20 is an enlarged view of the region designated XX in FIG. 19.

Flexible securing member 108 includes a distal end portion **108*a* having a ball-end 134 for engaging an attachment element in the form of a keyhole slot 136 that is formed or established in elongate body 102, such as shown in FIGS. 19-21. Keyhole slot 136 is sized and shaped to selectively receive and retain the ball-end 134 at distal end portion 108*a* of securing member 108 when the securing member is extended from the elongate body and wrapped around the tree or pole in a procedure that will be understood with reference to FIGS. 19-21. It will be appreciated that flexible securing member 108 need not be tightened to a high-tension condition in order to secure climbing support assembly 100 to the tree 110, and that it will generally be sufficient to use wrench 132 to take up most of the slack in the flexible securing member 108. This is because most of the support assembly 100 will initially move downwardly after flexible securing members 108 are wrapped around tree 110 and secured in slot 136, especially during an initial application of weight to elongate body 102 and/or steps 104, but the middle portions of flexible securing members 108 that are in contact with tree 110 will tend to stay in place due to surface roughness of the tree 110. This applies tension to flexible securing members 108, which causes standoffs 116 to be drawn into biting engagement with the opposite side of tree 110, so that flexible securing members 108 and standoffs 116 cooperate to secure the support assembly 110 after the securing members 108 are extended and secured, and especially after additional load is applied. This also limits or prevents support assembly 110 from jamming in its engagement with tree 110 after use, since lifting elongate body 102 will once again create slack in flexible securing members 108 and allow ball ends 134 to be readily removed from keyhole slots 136, so that flexible securing members 108 can be readily disengaged from the tree 110 and wound into retractors 106** for storage or transport.

Figure 3:
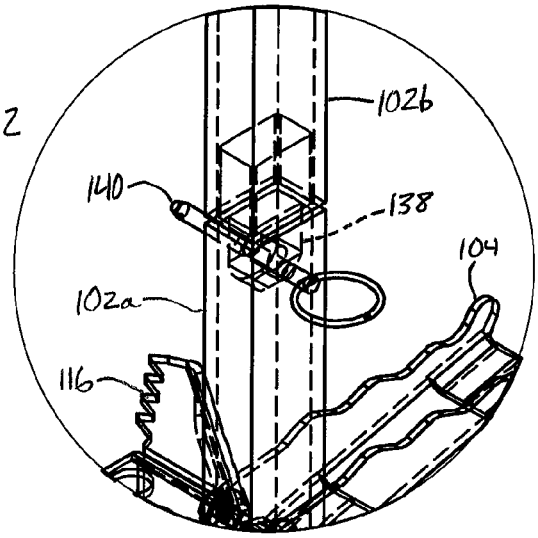
FIG. 3 is an enlarged view of the region designated III in FIG. 2.
Figure 4:
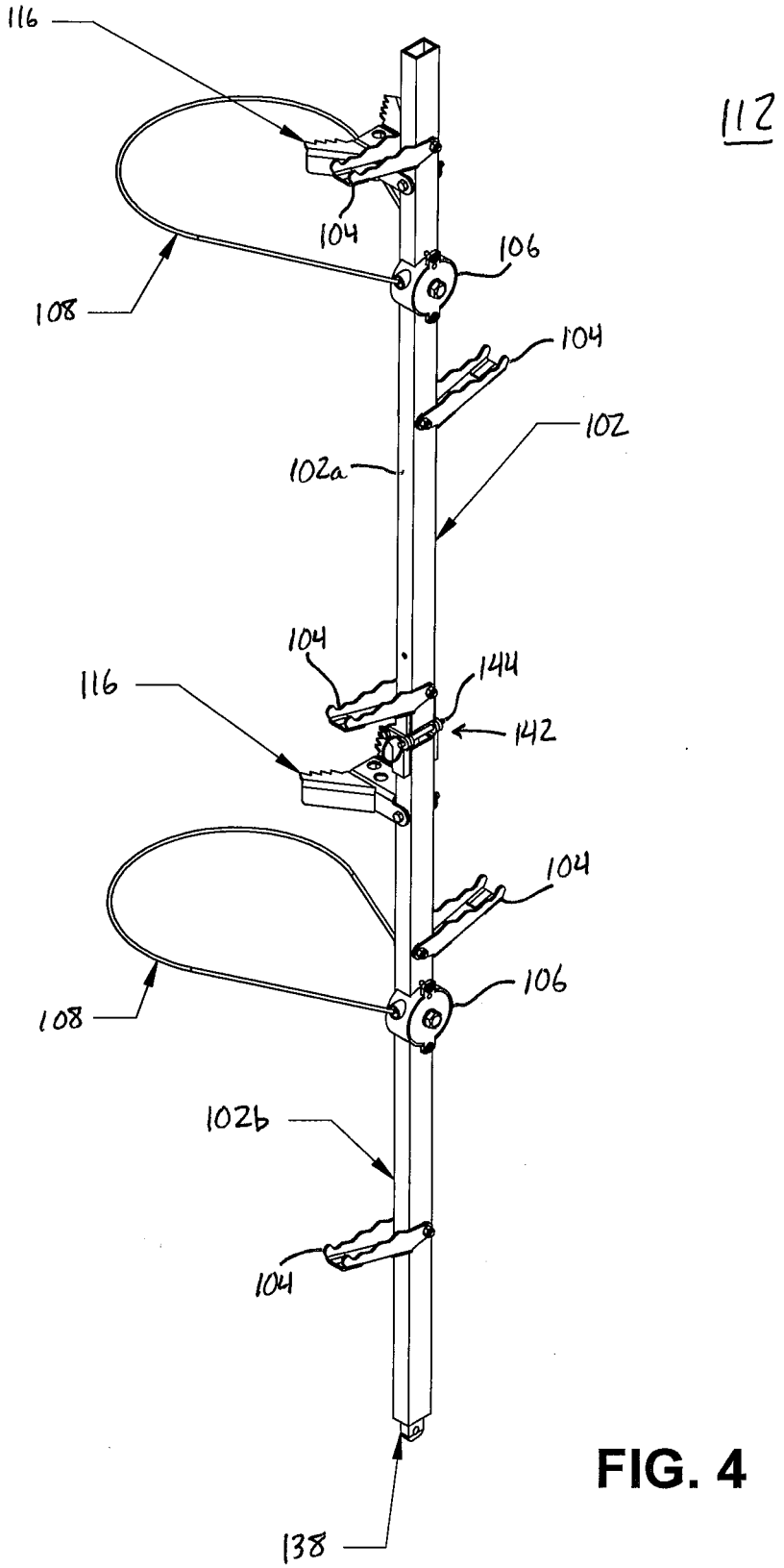
FIG. 4 is a perspective view of an upper subassembly of the climbing support of FIG. 1.
Figure 7:
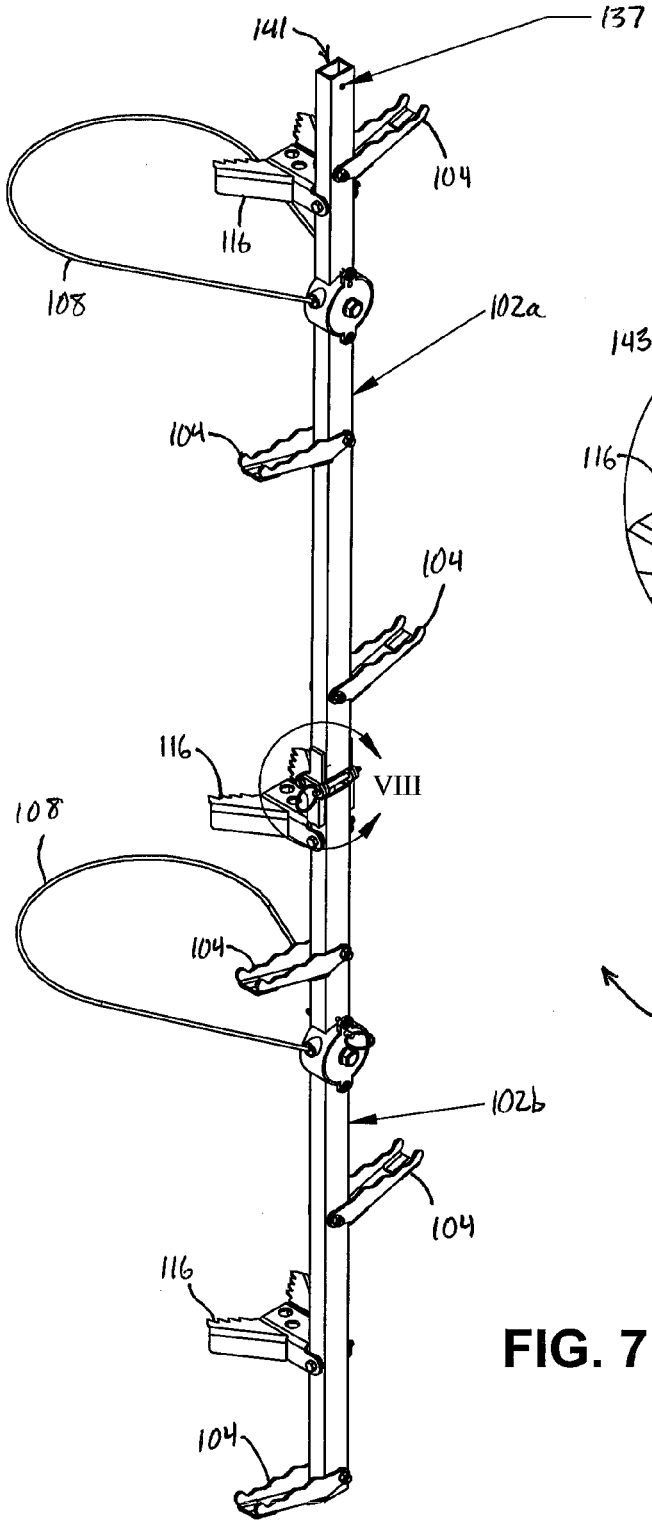
FIG. 7 is a perspective view of a lower subassembly of the climbing support of FIG. 1.

The upper climbing support subassembly 112 includes a lower engaging member in the form of a post 138 extending downwardly from a lower end of the elongate body 102 (FIGS. 4, 5, and 26-30), while the lower climbing support subassembly 114 includes an opening 141 in the upper end of the elongate body 102 (FIG. 7), which is configured to receive the post 138 so that the upper and lower climbing support subassemblies 112, 114 can be secured relative to one another. The subassemblies 112, 114 are securable via a lock pin 140 that is inserted through a bore 135 formed in post 138 and respective bores 137 formed in the elongate body 102 of lower climbing support subassembly 114 (near opening 141), such as shown in FIGS. 1-3.

In order to provide additional compactness for climbing support assembly 100 when in the stowage or transport configuration, the elongate body 102 of each climbing support subassembly 112, 114 includes an upper body portion 102*a* pivotably coupled to a lower body portion 102*b* via a hinge 142 (FIGS. 4-10), whereby the elongate body 102 is configurable between a compact configuration in which the upper body portion 102*a* is positioned alongside the lower body portion 102*b* in substantially parallel/adjacent arrangement (FIGS. 5, 6, 9, and 10), and an extended configuration in which the upper body portion 102*a* is positioned substantially in-line with the lower body portion 102*b* (FIGS. 1-4, 7, and 8).

Figure 6:
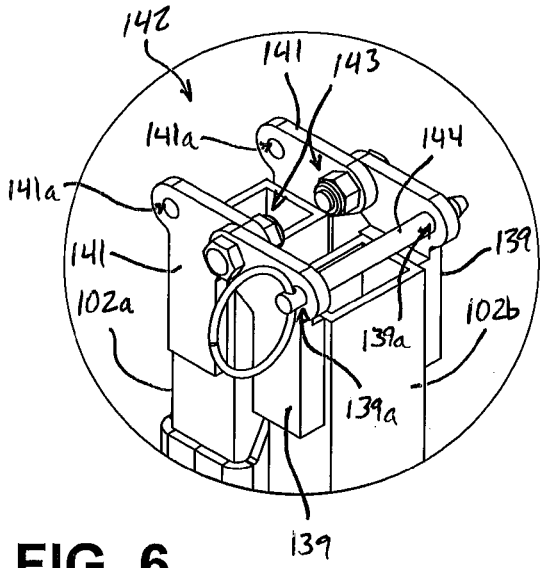
FIG. 6 is an enlarged view of the region designated VI in FIG. 5.
Figure 8:
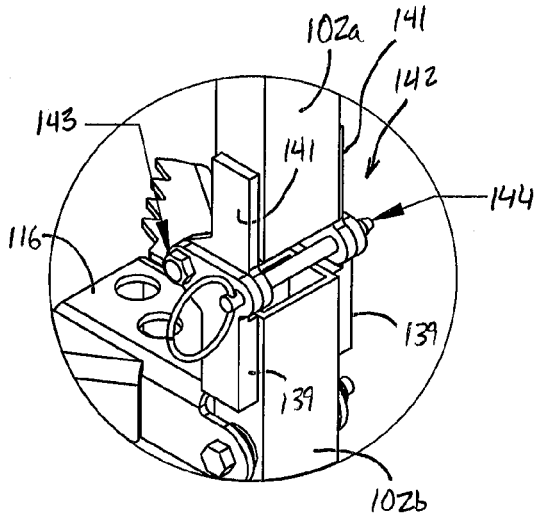
FIG. 8 is an enlarged view of the region designated VIII in FIG. 7.
Figure 10:
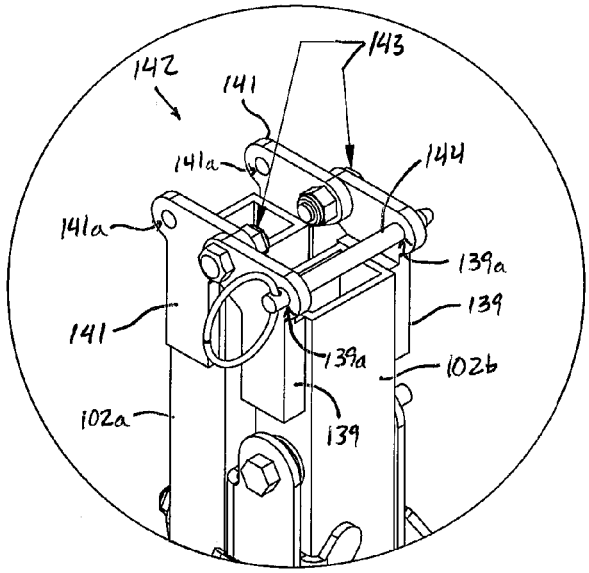
FIG. 10 is an enlarged view of the region designated X in FIG. 9.

Hinge 142 includes an upper bracket 139 at an upper end of lower body portion 102*b*, and a lower bracket 141 at a lower end of upper body portion 102*a*, such as shown in FIGS. 6, 8, and 10. Upper bracket 139 is pivotably coupled to lower bracket 141 via a pair of pivot bolts 143, while a lock pin or element 144 is positionable through respective bores 139*a*, 141*a* in upper bracket 139 and lower bracket 141, respectively (FIGS. 6 and 10), when upper body portion 102*a* and lower body portion 102*b* are aligned in the extended configuration (FIG. 8). Optionally, a releasable latch, strap, magnetic fastener, or the like may be provided at one or both of the upper and lower body portions 102*a*, 102*b* for retaining the body portions in the compact parallel/adjacent configuration.

Figure 11:
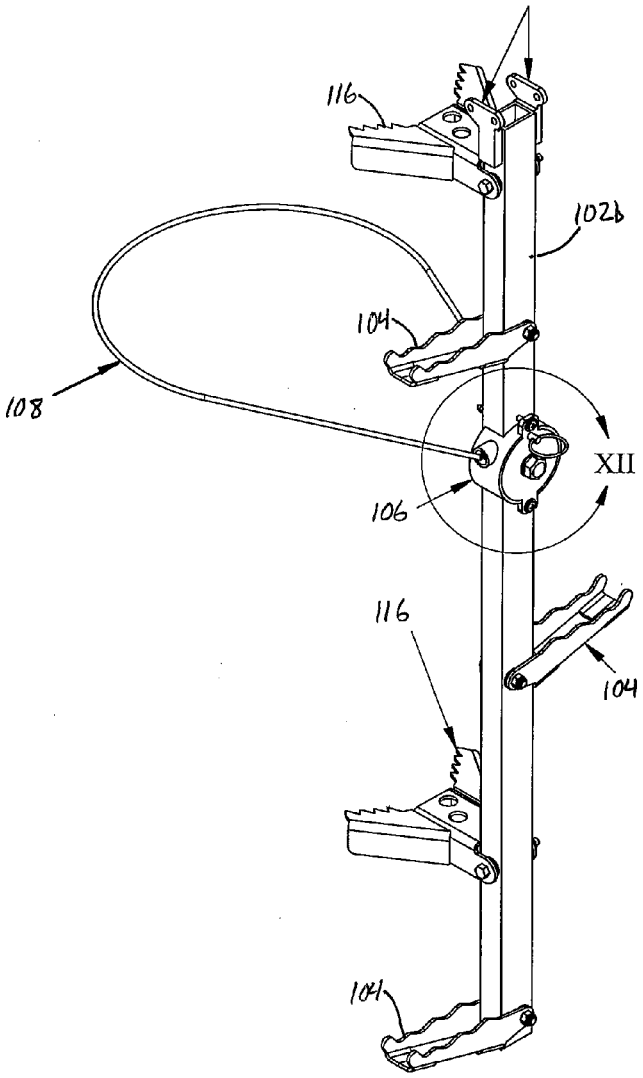
FIG. 11 is a perspective view of a lower portion of the lower subassembly of FIG. 7.
Figure 13:
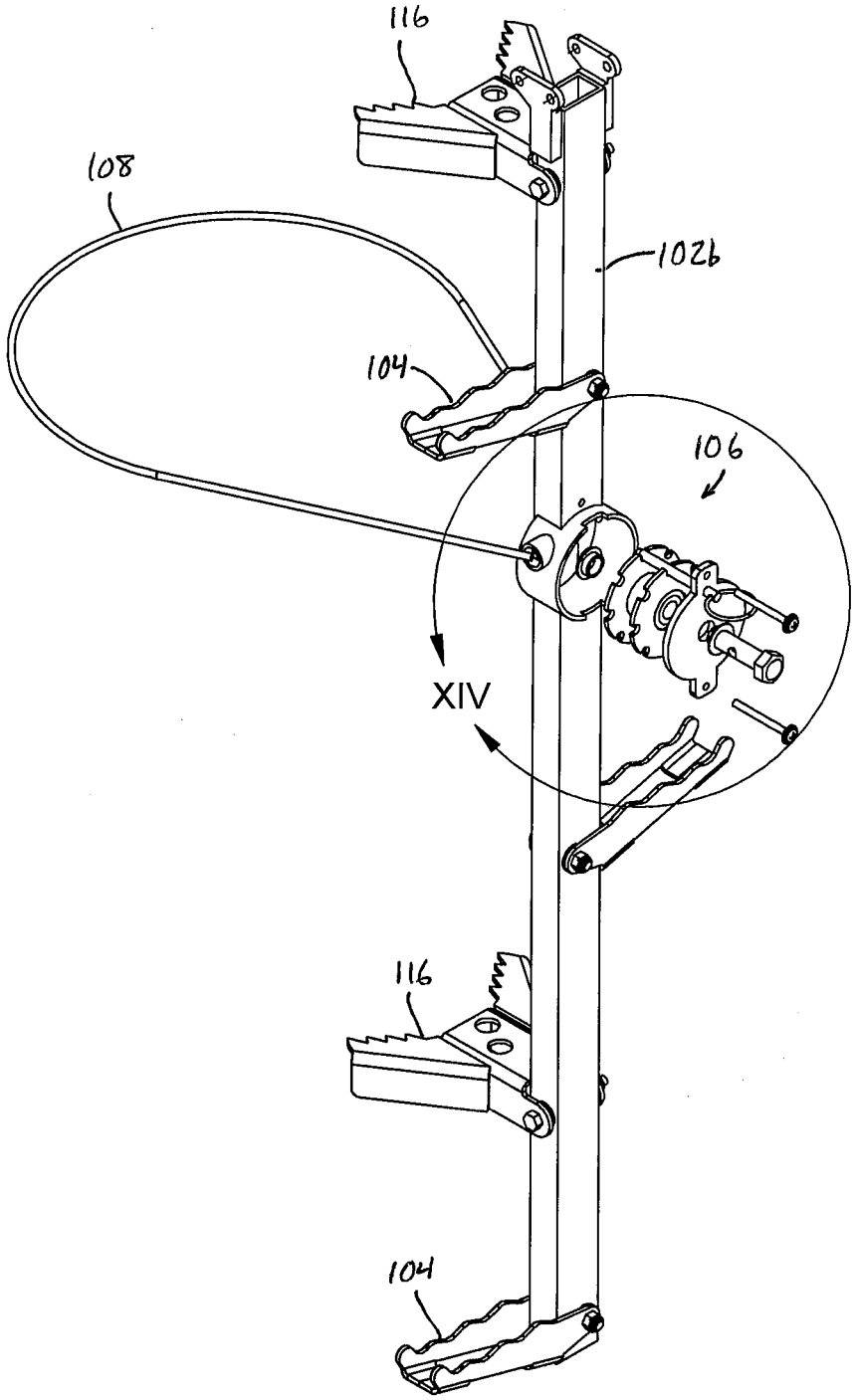
FIG. 13 is another perspective view of the lower subassembly portion of FIG. 11, with the cable retractor shown in an exploded view.

In the illustrated embodiment, lower climbing support subassembly 114 includes three standoffs 116, one of which is located at the upper end portion of the elongate body 102, and another of which is located at the lower end portion of the elongate body 102 (FIGS. 1-4 and 7). This allows lower climbing support subassembly 114 to be installed as a standalone unit along the tree 110, and it may be fully supported along the tree by two flexible securing members 108 and the three standoffs 116. However, in order to save weight and cost, in the illustrated embodiment upper climbing support subassembly 112 includes only two standoffs 116, which are located at the upper end portion and at a middle portion of its elongate body 102 (FIGS. 1, 2, and 11). The lower portion of the upper climbing support subassembly thus relies in part on the upper standoff 116 of the lower climbing support subassembly 114 to maintain the spacing of the upper climbing support subassembly's elongate body 102 at its lower end, such as shown in FIG. 1. Thus, if the upper climbing support subassembly 112 were to be coupled to the tree without being also secured to the lower climbing support subassembly 114, the lower portion of the upper climbing support subassembly's elongate body 102 may be expected to flex toward the tree 110 when supporting a user thereon, which may prevent the lower flexible securing member 108 from fully tensioning and supporting the weight. However, it is envisioned that the upper and lower climbing support subassemblies could both be configured for stand-alone use, and could be made substantially identical and interchangeable with one another, if desired, by providing sufficient standoffs for each subassembly, and by providing each subassembly with complementary posts and openings at the upper and lower ends of the elongate bodies so that two or more climbing support subassemblies may be coupled together to provide substantially any desired length (height) of climbing support assembly.

It is further envisioned that another climbing support assembly may include an alternative retractor that is at least partially integrated into the elongate body, and which does not require the use of tools for extending an retracting a flexible elongate securing member therefrom. For example, and with reference to FIGS. 36-43, an alternative climbing support assembly 200 is shown which includes an elongate body 202, fixed steps 204, an integral retractor system 206, a flexible securing member 208, and standoffs 216. Climbing support assembly 200 is similar to climbing support assembly 100, described above, except that steps 204 are fixed (although they could readily be made pivotable instead, like steps 104), elongate body 202 is a one-piece unit, and integral retractor system 206 is configured and operates differently from retractor 106, and utilizes a specially-shaped elongate body 202. Although retractor system 206 is primarily shown and described herein as being substantially internal to elongate body 202, it will be appreciated that different arrangements are possible, such as external or partially-external pulley arrangements. It will further be appreciated that climbing support assembly 200 may be equipped with pivoting steps and an elongate body made from two or more body portions that are pivotably attached to one another, similar to the climbing support assembly 100 described above.

Figures 41, 42, 43:
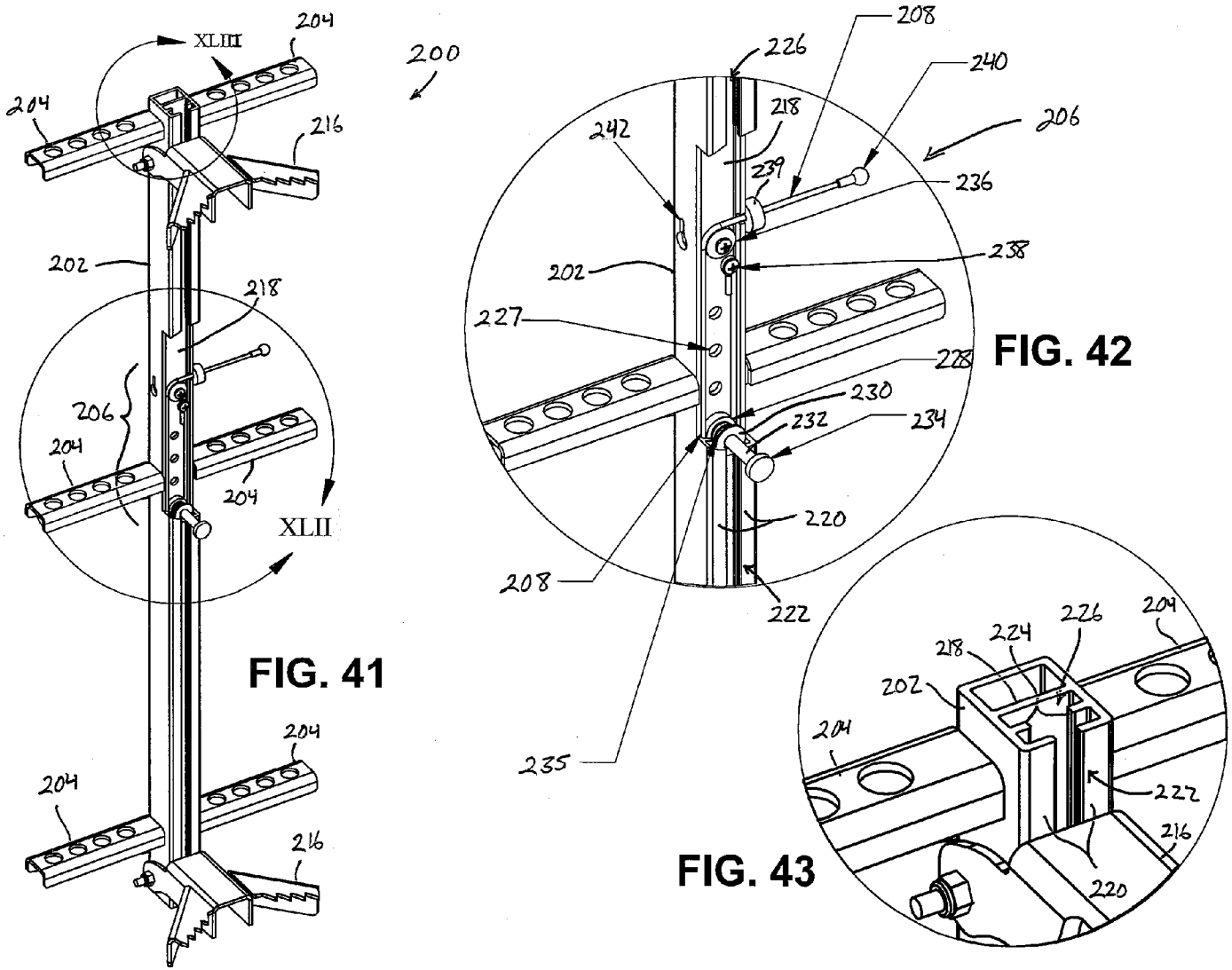
FIG. 41 is an enlarged rear perspective view of the climbing support of FIG. 36, with portions cut away to show internal structure and components.
FIG. 42 is an enlarged view of the region designated XLII in FIG. 41.
FIG. 43 is an enlarged view of the region designated XLIII in FIG. 41.

As best shown in FIG. 41-43, the retractor system 206 is mostly internal to the hollow elongate body 202, and the elongate body 202 itself forms part of retractor system 206. Elongate body 202 is generally rectangular or square in shape, and includes an internal divider wall 218 (FIG. 43) along its length. A pair of front walls 220 forms the front surface of elongate body 202, and cooperate to define an external elongate slot 222 therebetween. Two intermediate ledges or walls 224 are spaced between front walls 220 and internal divider wall 218, and also define an internal elongate slot 226 therebetween. Internal divider wall 218 includes a plurality of bores 227 in longitudinally-spaced arrangement, and which are accessible through the elongate slots 222, 226. Front walls 220 may be at least partially notched or cut away to form an access opening 229 (FIGS. 37 and 39) that facilitates access to portions of integral retractor system 206, including stationary and movable pulleys, and a flexible securing member (e.g., a cable) and cable end anchor that are described below. Optionally, a cover may be removably fastened over access opening 229.

A rotatable and selectively translatable tensioning pulley 228 is mounted between internal divider wall 218 and intermediate ledges 224, and has a spaced flange 230 that is received between front walls 220 and intermediate ledges 224 (FIG. 42). Tensioning pulley 228 and flange 230 are both mounted to a pulley shaft 232, an outboard portion of which protrudes outwardly through external elongate slot 222 and terminates in a knob 234 intended for grasping by a user. An inboard portion of pulley shaft 232 extends through internal elongate slot 226, and an inboard tip portion or locking portion selectively extends inward past tensioning pulley 228 to engage one of bores 227. When the inboard tip portion of pulley shaft 232 engages one of the bores 227 formed in internal divider wall 218, tensioning pulley 228 is secured or locked against translating movement relative to elongate body 202. A spring 235 is positioned around pulley shaft 232 and located between tensioning pulley 228 and intermediate ledges 224, where it is held in compression and urges the inboard tip portion of pulley shaft 232 into engagement with one of the bores 227 when the shaft 232 is aligned with that bore 227.

A non-translatable stationary (but rotatable) pulley 236 is coupled to the elongate body 202 at internal divider wall 218, and is spaced above tensioning pulley 228. As will be described in more detail below, flexible securing member 208 is partially wrapped around stationary pulley 236 where the securing member exits elongate body 202, such as shown in FIG. 42. A fixed end of flexible securing member 208 is coupled to elongate body 202 at an anchor 238, which is fastened to internal divider wall 218 at a location slightly below stationary pulley 236 (although anchor 238 could be coupled elsewhere, such as above pulley 236).

With the fixed end of flexible securing member 208 attached to anchor 238, a middle portion of the securing member is routed downwardly and then wrapped ½ turn around tensioning pulley 228, after which the securing member 208 is routed upwardly until it reaches stationary pulley 236, where it completes a ¼ turn and exits out the side of elongate body 202 through a hole provided for that purpose (FIG. 42). Flexible securing member 208 is thus routed internally to elongate body 208 and, in the illustrated embodiment, is positioned in a generally rectangular chamber formed between internal divider wall 218 and intermediate ledges 224. A cable stopper 239 near the distal end of flexible securing member 208 prevents the distal end from retracting into elongate body 202, and a ball end 240 is configured to be received and removably secured in a keyhole slot 242 formed in the side of elongate body.

When tensioning pulley 228 is moved downwardly or away from stationary pulley 236, the increased distance between the pulleys 228, 236 draws additional length of flexible securing member 208 into elongate body 202. Because of the pulleys' multiplying effect, a given distance of movement of tensioning pulley 228 results in double that length of flexible securing member 208 being drawn into the elongate body 202, such as for drawing in slack when securing the climbing support assembly 200 to a tree. Conversely, moving tensioning pulley 228 upwardly or toward stationary pulley 236 allows the distal end of the flexible securing member 208 to be drawn out from the elongate body 202, such as for adding slack to the flexible securing member 208 when initially wrapping the securing member around the tree, or when loosening the securing member to remove the climbing support assembly 200 from the tree.

Tensioning pulley 228 is moved by grasping knob 234 of pulley shaft 232 and pulling outwardly to disengage the inboard tip portion of the pulley shaft 232 from one of the bores 227 formed in the internal divider wall 218, against the biasing force of spring 235. The user then slides the pulley shaft 232 toward or away from (e.g., upwardly or downwardly) stationary pulley 236 to either slacken the flexible securing member 208, or to take up slack in the securing member, respectively. Once the desired slack or tension is achieved, the user may release the knob 234 so that the inboard tip portion of the pulley shaft 232 engages the closest bore 227 in internal divider wall 218. The user may urge pulley shaft 232 slightly upward or downward as necessary to achieve proper alignment of the pulley shaft 232 with a bore 227. Accordingly, the exposed length or tension of flexible securing member 208 may be readily adjusted by a user with a single hand, including a gloved hand, so that the other hand can be used for stabilizing the user as needed.

The climbing support assemblies described above may be made primarily from steel or aluminum alloy or the like. For example, sheet steel or aluminum may be cut and formed (e.g., bent, welded, etc) to the desired shapes, and optionally painted, powder-coated, or epoxy-coated as a final finish, which could optionally be a camouflage pattern, for example. However, it will be appreciated that numerous other sufficiently strong and corrosion-resistant materials may be suitable, such as high-strength composite materials or the like.

Accordingly, the present invention provides climbing support assemblies that can generally be installed by a single user along a tree, pole, or the like, to facilitate reaching a substantial distance up above the ground. The climbing support assemblies can be configured in a compact stowage or transport configuration so that several assemblies may be carried at once by a single user, and include retractors for convenient and non-tangled stowage of securing cables, straps, or the like when the assemblies are not in use. Once the climbing support assembly is fully secured, the steps may be used as handholds and/or foot-holds as a climber scales a tree or other surface to which the climbing apparatus is attached. A standoff increases the space between the steps and the tree, and cooperates with the flexible securing member to support and stabilize the climbing support assembly along a tree or pole. The standoff and the steps may be repositionable between use configurations and more compact storage or transport configurations, and the elongate body or main frame member of the assembly may be collapsible to reduce its overall length for storage or transport.

Changes and modifications in the specifically-described embodiments can be carried out without departing from the principles of the present invention which is intended to be limited only by the scope of the appended claims, as interpreted according to the principles of patent law including the doctrine of equivalents.

The invention claimed is:

1. A climbing support for use in climbing a tree or pole, said climbing support comprising:

an elongate body comprising a hollow interior region;

a step member extending outwardly from said elongate body;

a flexible elongate securing member coupled to said elongate body, wherein at least a portion of said securing member is mounted inside said interior region and is selectively extendable outwardly from said interior region and said elongate body and configured to wrap around a tree or pole to thereby attach the climbing support thereto, and wherein said securing member is retractable into said interior region of said elongate body for compact storage or transport when said securing member is not in use; and a retractor disposed at least partially inside said interior region of said elongate body, said retractor operable to selectively retract at least a proximal portion of said securing member for storage inside said interior region, and operable to permit said securing member to be extended outwardly from said elongate body, whereby said securing member is selectively extendable and retractable relative to said elongate body.

2. The climbing support of claim 1, wherein said retractor comprises an outer casing that is received in a cut-away portion of said elongate body with at least a portion of said outer casing received in said interior region, and said retractor further comprises a spool for selectively winding and unwinding said securing member between the retracted and extended configurations.

3. The climbing support of claim 2, wherein said retractor comprises at least one chosen from (i) a tool-engaging head to facilitate manual rotation of said spool with a tool, (ii) a spring configured to bias said spool to rotate for winding said securing member onto said spool, and (iii) a ratcheting mechanism for securing said spool against unintended unwinding of said securing member.

4. The climbing support of claim 1, wherein said retractor comprises a lock member for selectively securing said spool against rotation.

5. The climbing support of claim 1, wherein said step member is pivotably coupled to said elongate body, and is pivotable between an outwardly-extending position for use as a hand-hold or foot support, and a retracted position for compact stowage along said elongate body.

6. The climbing support of claim 1, further comprising a standoff member pivotably coupled to said elongate body and configured to engage the tree or pole and to maintain a space between said elongate body and the tree or pole when said securing member is wrapped around the tree or pole, wherein said standoff member is repositionable between a substantially horizontal orientation for engaging the tree or pole, and a substantially vertical orientation along said elongate body for compact stowage and transport.

7. The climbing support of claim 1, wherein said securing member comprises at least one chosen from (i) a rope, (ii) a cord, (iii) a cable, (iv) a strap, and (v) a chain, or a combination thereof.

8. The climbing support of claim 1, wherein said elongate body comprises an opening for selectively receiving and retaining a distal end portion of said securing member when said securing member is extended from said elongate body and wrapped around the tree or pole.

9. The climbing support of claim 1, comprising at least two climbing support subassemblies configured to be arranged end-to-end, each of said subassemblies comprising at least one of said elongate bodies and at least one of each of (i) said step member, (ii) said securing member, and (iii) said retractor.

10. The climbing support of claim 9, wherein:

a first of said climbing support subassemblies comprises a first engaging member at a lower end thereof;

a second of said climbing support subassemblies comprises a second engaging member at an upper end thereof; and said first and second climbing support subassemblies are securable to one another via engagement of said first and second engaging members.

11. The climbing support of claim 10, wherein said first engaging member comprises a post extending downwardly from said elongate body of said first climbing support subassembly, and wherein said second engaging member comprises an opening in said elongate body of said second climbing support subassembly.

12. The climbing support of claim 11, further comprising a lock pin for selectively securing said first and second engaging members together, wherein said first and second engaging members comprise respective bores that align to receive said lock pin.

13. The climbing support of claim 1, wherein said elongate body comprises an upper body portion pivotably coupled to a lower body portion via a hinge, whereby said elongate body is configurable between a compact configuration in which said upper body portion is positioned alongside said lower body portion in substantially parallel arrangement, and an extended configuration in which said upper body portion is positioned substantially in-line with said lower body portion.

14. The climbing support of claim 13, wherein said hinge comprises a lock element configured to selectively secure said elongate body in said extended configuration.

15. A climbing support for use in climbing a tree or pole, said climbing support comprising:

first and second elongate bodies comprising respective hollow interior regions and pivotably coupled together and configurable between a compact configuration in which said first elongate body is positioned alongside said second elongate body portion in substantially parallel arrangement, and an extended configuration in which said first body portion is positioned substantially in-line with said second body portion;

a step member pivotably coupled to at least one of said first and second elongate bodies, wherein said step member is positionable between an extended use position and a retracted transport position;

a standoff member pivotably coupled to at least one of said first and second elongate bodies and configured to engage the tree or pole and to maintain a space between said elongate bodies and the tree or pole, wherein said standoff member is repositionable between a substantially horizontal orientation for engaging the tree or pole, and a substantially vertical orientation along said at least one of said first and second elongate bodies for compact stowage and transport;

a retractor disposed at least partially inside said interior region of one of said first and second elongate bodies; and a flexible elongate securing member having a proximal portion mounted at said retractor and disposed inside said interior region of said one of said first and second elongate bodies, wherein at least a distal portion of said securing member is selectively extendable from said interior region of said elongate body and is configured to wrap around a tree or pole to thereby attach the climbing support thereto, and wherein said distal portion of said securing member is at least partially retractable into said interior region of said elongate body for compact storage or transport when said securing member is not in use.

16. The climbing support of claim 1, wherein said retractor is spaced longitudinally along said elongate body from said step member.

* * * * *